US010122090B2

(12) United States Patent
Bevelacqua et al.

(10) Patent No.: US 10,122,090 B2
(45) Date of Patent: Nov. 6, 2018

(54) ANNTENA CONFIGURATIONS FOR WIRELESS DEVICES

(71) Applicant: Google Inc., Mountain View, CA (US)

(72) Inventors: Peter Bevelacqua, Mountain View, CA (US); Paul Biggins, Mountain View, CA (US)

(73) Assignee: GOOGLE LLC, Mountain View, CA (US)

( * ) Notice: Subject to any disclaimer, the term of this patent is extended or adjusted under 35 U.S.C. 154(b) by 234 days.

(21) Appl. No.: 14/977,062

(22) Filed: Dec. 21, 2015

(65) Prior Publication Data

US 2017/0179599 A1 Jun. 22, 2017

(51) Int. Cl.

| | |
|---|---|
| ***H01Q 1/48*** | (2006.01) |
| ***H01Q 9/04*** | (2006.01) |
| ***H01Q 1/38*** | (2006.01) |
| *H01Q 1/24* | (2006.01) |

(52) U.S. Cl.
CPC ..... *H01Q 9/0407* (2013.01); *H01Q 1/38* (2013.01); *H01Q 1/243* (2013.01); *H01Q 1/48* (2013.01)

(58) Field of Classification Search
CPC ..... H01Q 1/243; H01Q 9/40; H01Q 9/0407
See application file for complete search history.

(56) References Cited

U.S. PATENT DOCUMENTS

| | | | | |
|---|---|---|---|---|
| 4,186,400 | A | 1/1980 | Cermignani et al. | |
| 7,859,469 | B1 * | 12/2010 | Rosener | H01Q 1/22 343/702 |
| 8,102,323 | B2 | 1/2012 | Chen | |
| 8,995,699 | B2 | 3/2015 | Christensen et al. | |
| 9,048,539 | B2 | 6/2015 | Yen | |
| 2002/0113709 | A1 | 8/2002 | Helms et al. | |

(Continued)

FOREIGN PATENT DOCUMENTS

WO WO2005022853 * 3/2005

OTHER PUBLICATIONS

"Tip to Reduce Radio Interference on the RTL-SDR", "Tip to Reduce Radio Interference on the RTL-SDR," Sep. 5, 2013, at http://www.rtl-sdr.com/tip-reduce-radio-interference-rtl-sdr/ last visited Nov. 4, 2015.

(Continued)

*Primary Examiner* — Hoang Nguyen
*Assistant Examiner* — Awat Salih
(74) *Attorney, Agent, or Firm* — Morris & Kamlay LLP

(57) ABSTRACT

A wireless device can include an antenna element, a printed circuit board, an antenna feed, a conductive surface, and a conductive connector. The printed circuit board can have a ground plane. The antenna feed can be connected, at a first point, to the antenna element and to the ground plane. The conductive surface can be disposed substantially parallel to the ground plane. The conductive connector can be connected, at a second point, to the ground plane and to the conductive surface. A distance between the first point and the second point can be substantially equal to one quarter of a wavelength of an electromagnetic wave to be exploited by the wireless device. At all other points, the ground plane and the conductive surface can lack a conductive connection between the ground plane and the conductive surface.

19 Claims, 16 Drawing Sheets

(56) References Cited

U.S. PATENT DOCUMENTS

2004/0217916 A1* 11/2004 Quintero Illera ..... H01Q 1/36 343/895
2006/0244668 A1 11/2006 Iellici et al.
2009/0174617 A1 7/2009 Chen et al.
2009/0195474 A1* 8/2009 Chien ..... H01Q 1/243 343/846
2010/0103053 A1* 4/2010 Nikitin ..... H01Q 1/2216 343/702
2011/0156962 A1 6/2011 Jeong et al.
2011/0221638 A1* 9/2011 Lin ..... H01Q 1/243 343/700 MS
2012/0154222 A1* 6/2012 Oh ..... H01Q 1/243 343/702
2013/0009836 A1* 1/2013 Islam ..... H01Q 1/241 343/810
2013/0076580 A1 3/2013 Zhang et al.
2013/0146773 A1 6/2013 Ouvrier-Buffet et al.
2013/0169504 A1 7/2013 Jenwatanavet et al.
2013/0257671 A1* 10/2013 Chen ..... H04B 15/04 343/841
2013/0285880 A1 10/2013 Zaghloul et al.
2014/0043198 A1* 2/2014 Shimura ..... H01Q 1/243 343/843
2014/0168027 A1 6/2014 Katipally et al.
2014/0184469 A1* 7/2014 Yoshino ..... H01Q 1/46 343/906
2014/0210680 A1 7/2014 Stoytchev et al.
2014/0285289 A1 9/2014 Herbsommer et al.
2016/0013560 A1* 1/2016 Daniels ..... H01Q 9/42 343/700 MS

OTHER PUBLICATIONS

Andrews, "The Collinear Antenna Array Theory and Measurements", "The Collinear Antenna Array Theory and Measurements," Technical Report No. 178, Office of Naval Research, Jul. 15, 1953, Cruft Laboratory, Harvard University, Cambridge, Massachusetts.
Caballero, "Choosing your Antenna", "Choosing your Antenna," Roughclaw Technologies, at http://roughclaw.com/Choosing-Your-Antenna.php, last visited Nov. 17, 2015.
Donovan, "Selecting Antenna for Embedded Designs", "Selecting Antenna for Embedded Designs," Digi-Key Electronics, Nov. 8, 2012, at http://www.digikey.com/en/articles/techzone/2012/nov/selecting-antennas-for-embedded-designes, last visited Nov. 17, 2015.
Thiel, "Using mutual coupling to calculate the radiation pattern for parasitic patch antennas", , "Using mutual coupling to calculate the radiation pattern for parasitic patch antennas," Radio Science Laboratory, Griffith University, Nathan, Queensland, Australia, 2003.

* cited by examiner

ANNTENA CONFIGURATIONS FOR WIRELESS DEVICES

BACKGROUND

An antenna is an electromagnetic (EM) device configured to cause an EM wave to transition between being propagated in a confined medium and being propagated in an unconfined medium. The confined medium can be, for example, a transmission line, a waveguide, a coaxial cable, the like, or any combination of these. The unconfined medium can be, for example, air, space, or a combination of these. An antenna is used to receive an EM wave from being propagated in an unconfined medium to being propagated in a confined medium. Conversely, an antenna is used to transmit an EM wave from being propagated in a confined medium to being propagated in an unconfined medium. Antennas are essential components of equipment used in systems configured to exploit the propagation of EM waves in unconfined media. Such systems can include, for example, broadcast radio, broadcast television, two-way radio, radar, mobile telephones, cellular communications, satellite communications, wireless computer networks, wireless personal area networks, space-based navigation systems, radio astronomy, and the like.

A resonant antenna is designed to produce a standing EM wave, related to a specific wavelength (or range of wavelengths), between two terminals of the antenna. An antenna element of a resonant antenna can have a length equal to one quarter of the specific wavelength. However, a standing EM wave can also be produced when the length of the antenna element is shorter than one quarter of the specific wavelength by increasing the capacitive reactance of the impedance of the antenna. Similarly, a standing EM wave can also be produced when the length of the antenna element is longer than one quarter of the specific wavelength by increasing the inductive reactance of the impedance of the antenna. In this manner, an electrical length of an antenna element can be longer than a physical length of the antenna element when a standing EM wave can also be produced when the physical length of the antenna element is shorter than one quarter of the specific wavelength. Likewise, a standing EM wave can also be produced when the length of the antenna element is longer than one quarter of the specific wavelength by decreasing the capacitive reactance of the impedance of the antenna. Similarly, a standing EM wave can also be produced when the length of the antenna element is shorter than one quarter of the specific wavelength by decreasing the inductive reactance of the impedance of the antenna. In this manner, an electrical length of an antenna element can be shorter than a physical length of the antenna element when a standing EM wave can also be produced when the physical length of the antenna element is longer than one quarter of the specific wavelength.

A dipole antenna is a common form of a resonant antenna. A dipole antenna includes two antenna elements typically disposed symmetrically with respect to each other. When a dipole antenna is used to transmit an EM wave, an electrical signal, characterized by a specific wavelength, is provided in a balanced manner to the interior terminals of each of the antenna elements. The electrical signal in this case is represented by the oscillation of equal but opposite currents. One of the currents is provided to the interior terminal of one of the antenna elements and the equal but opposite current is provided to the interior terminal of the other one of the antenna elements. Because the currents cannot flow beyond the exterior terminals of each of the antenna elements, the oscillation of the currents causes an oscillation of accumulated charges at the exterior terminals of each of the antenna elements, which in turn causes an oscillation of voltages between the exterior terminals of the antenna elements. The oscillation of the currents and the voltages causes a standing EM wave to be produced between the exterior terminals of the antenna elements. The standing EM wave is characterized by a measure of currents at the exterior terminals that is effectively zero and a measure of currents at the interior terminals that oscillates between a maximum value in one direction and an equal maximum value in the opposite direction. The standing EM wave is further characterized by a measure of voltages at the interior terminals that is effectively zero and a measure of voltages at the exterior terminals that oscillates between a maximum value and an equal but opposite maximum value.

A monopole antenna is another common form of a resonant antenna. A monopole antenna includes an antenna element typically disposed perpendicular to a ground plane. The ground plane typically is a conductive surface and ideally has an infinite length and an infinite width. To be effective, the ground plane should have a length at least equal to one quarter of the specific wavelength. The ground plane can be the actual ground (i.e., the earth), can be connected to the actual ground, or can be separated from the actual ground. When a monopole antenna is used to transmit an EM wave, an electrical signal, characterized by the specific wavelength, is provided in a balanced manner to the ground plane and to the terminal (of the antenna element) nearest to the ground plane. Because the current provided to the terminal nearest to the ground plane cannot flow beyond the terminal (of the antenna element) farthest from the ground plane, the oscillation of the current causes an oscillation of accumulated charges at the terminal farthest from the ground plane, which in turn causes an oscillation of voltages between the terminals of the antenna element. The oscillation of the currents and the voltages causes a standing EM wave to be produced between the terminals of the antenna element. The standing EM wave is characterized by a measure of current at the terminal farthest from the ground plane that is effectively zero and a measure of current at the terminal nearest to the ground plane that oscillates between a maximum value in one direction and an equal maximum value in the opposite direction. The standing EM wave is further characterized by a measure of voltage at the terminal nearest to the ground plane that is effectively zero and a measure of voltage at the terminal farthest from the ground plane that oscillates between a maximum value and an equal but opposite maximum value. The ground plane acts to reflect the EM wave that radiates from the antenna element. Ideally, the reflection of the EM wave is such that the radiation pattern from the monopole antenna resembles a radiation pattern that would be produced from a theoretical dipole antenna having both the antenna element of the monopole antenna and another antenna element symmetrically disposed on the other side of the ground plane.

BRIEF SUMMARY

According to an embodiment of the disclosed subject matter, a wireless device can include an antenna element, a printed circuit board, an antenna feed, a conductive surface, and a conductive connector. The printed circuit board can have a ground plane. The antenna feed can be connected, at a first point, to the antenna element and to the ground plane of the printed circuit board. The conductive surface can be disposed substantially parallel to the ground plane of the printed circuit board. The conductive connector can be connected, at a second point, to the ground plane of the printed circuit board and to the conductive surface. A distance between the first point and the second point can be substantially equal to one quarter of a wavelength of an electromagnetic wave to be exploited by the wireless device. At all other points, the ground plane of the printed circuit board and the conductive surface can lack a conductive connection between the ground plane of the printed circuit board and the conductive surface.

According to an embodiment of the disclosed subject matter, a wireless device can include a printed circuit board, a power cord, and a ground extension. The printed circuit board can have a ground plane. The power cord can have a connector configured to connect, at a first point, the power cord to the ground plane of the printed circuit board. The ground extension can be disposed on or within a housing of the wireless device. The ground extension can be connected, at a second point, to the ground plane of the printed circuit board. The second point can be substantially opposite the first point. A ground plane of an antenna of the wireless device can include the ground plane of the printed circuit board, the power cord, the connector, and the ground extension.

According to an embodiment of the disclosed subject matter, a wireless device can include a printed circuit board, a holder, and a driven antenna element. The printed circuit board can have a ground plane. The holder can be disposed near a first edge of the printed circuit board. The holder can be configured to hold a battery. The driven antenna element can have a first elongated portion, a second elongated portion, and a third elongated portion. The first elongated portion can have a first end and a second end. The first end of the first elongated portion can be connected to the printed circuit board. The first elongated portion can be disposed substantially perpendicular to the ground plane of the printed circuit board. The second elongated portion can have a first end and a second end. The first end of the second elongated portion can be connected to the second end of the first elongated portion. The second elongated portion can be disposed substantially parallel to the ground plane of the printed circuit board. A distance between the second end of the second elongated portion and the first edge of the printed circuit board can be greater than a distance between the first end of the second elongated portion and the first edge of the printed circuit board. The third elongated portion can have a first end and a second end. The first end of the third elongated portion can be connected to the second end of the second elongated portion. The third elongated portion can be disposed substantially parallel to the ground plane of the printed circuit board. The third elongated portion can be substantially perpendicular to the second elongated portion.

Additional features, advantages, and embodiments of the disclosed subject matter are set forth or apparent from consideration of the following detailed description, drawings, and claims. Moreover, it is to be understood that both the foregoing summary and the following detailed description are illustrative and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

DETAILED DESCRIPTION

Designing an antenna of a wireless device to operate within one or more specific electromagnetic (EM) frequency bands can require several issued to be addressed. For example, wavelengths that correspond to the one or more specific EM frequency bands can be longer than a longest dimension of the wireless device. Such wavelengths can make incorporation of a ground plane of an antenna into the wireless device difficult to accomplish. Furthermore, designing a wireless device to use the actual ground (i.e., the earth) as the ground plane of the antenna can be impractical. Aspects disclosed herein describe a wireless device in which a ground plane of an antenna can be formed from a substantial amount of the total conductive material of the wireless device.

Additionally, industrial design constraints, safety concerns, and/or aesthetic preferences often can preclude use of an external antenna. Moreover, because the wavelengths that correspond to the one or more specific EM frequency bands can be longer than the longest dimension of the wireless device, such wavelengths can also preclude the use of a patch antenna (also known as a microstrip) formed in a printed circuit board of the wireless device. Aspects disclosed herein also describe a wireless device with an integrated antenna formed within other components of the wireless device, from other components of the wireless device, or both.

The term substantially, as used herein, is understood by one of ordinary skill in the art to allow for a reasonable degree of deviation from a precise definition of another term. For example, substantially parallel (or perpendicular) can be understood to encompass a description of a predominant, if not exact, spatial relationship between two elements. In another example, substantially equal to a fraction of a wavelength can be understood to include those degrees of deviations from precisely the fraction of the wavelength in which the antenna can function for its intended purpose. Likewise, having a measure of a dimension of a first element be substantially equal to the measure of the dimension of a second element can be understood to include those degrees of deviations from precisely equal measures in which the antenna can function for its intended purpose. In another example, having a substantially cylindrical shape can be understood to refer to a description of a shape that reasonably matches an actual shape of a realization of a wireless device. In another example, having a first point substantially opposite a second point can be understood to include a spatial relationship in which the second point can be on or reasonably near to a line that passes through the first point and a center point of a closed curve on a plane that includes the first point and the second point.

Figure 1:
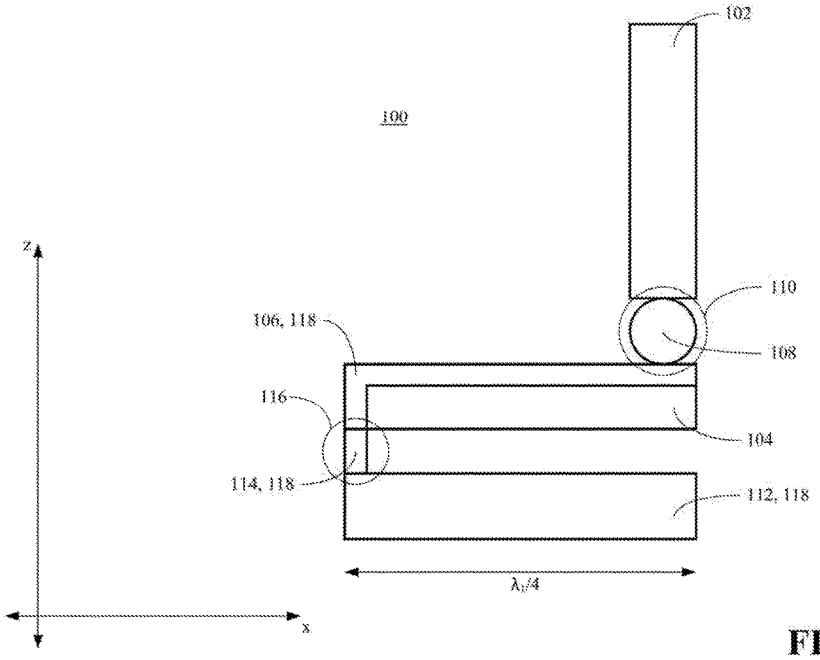
FIG. 1 is a block diagram illustrating a side view of an example of an embodiment of a wireless device according to the disclosed subject matter.

FIG. 1 is a block diagram illustrating a side view of an example of an embodiment of a wireless device 100 according to the disclosed subject matter. The wireless device 100 can include an antenna element 102, a printed circuit board 104, an antenna feed 108, a conductive surface 112, and a conductive connector 114. For example, the antenna element 102 can be a component of an external antenna, an internal antenna, an integrated antenna, or any combination thereof. The printed circuit board 104 can have a ground plane 106. The antenna feed 108 can be connected, at a point 110, to the antenna element 102 and to the ground plane 106 of the printed circuit board 104. The conductive surface 112 can be disposed substantially parallel to the ground plane 106 of the printed circuit board 104. The conductive connector 114 can be connected, at a point 116, to the ground plane 106 of the printed circuit board 104 and to the conductive surface 112. A distance between the point 110 and the point 116 can be substantially equal to one quarter of a wavelength ($\lambda_1$) of a first electromagnetic wave to be exploited by the wireless device 100. At all other points, the ground plane 106 of the printed circuit board 104 and the conductive surface 112 can lack a conductive connection between the ground plane 106 of the printed circuit board 104 and the conductive surface 112. A ground plane 118 of an antenna of the wireless device 100 can include the ground plane 106 of the printed circuit board 104, the conductive surface 112, and the conductive connector 114.

In an aspect, an angle of 0°, an angle between 0° and 180°, or an angle of 180° can be formed between the antenna element 102 and the ground plane 106 of the printed circuit board 104. For example, the antenna element 102 can be disposed substantially perpendicular to the ground plane 106 of the printed circuit board 104.

When an electrical signal having a center frequency that corresponds to the wavelength ($\lambda_1$) is provided, by the antenna feed 108, in a balanced manner to the antenna element 102 and to the ground plane 106 of the printed circuit board 104, an oscillation of a current of the electrical signal can occur in the ground plane 106 of the printed circuit board 104. Because the point 116 can effectively be a terminal beyond which the current of the electrical signal cannot flow, the oscillation of the current can cause an oscillation of accumulated charges at the point 116, which in turn can cause an oscillation of voltages between the point 116 and the point 110. The oscillation of the currents and the voltages can cause a standing EM wave to be produced between the point 116 and the point 110. With the distance between the point 116 and the point 110 substantially equal to one quarter of the wavelength ($\lambda_1$), the standing EM wave can be characterized by a measure of the current at the point 116 that is effectively zero and a measure of the current at the point 110 that oscillates between a maximum value in one direction and an equal maximum value in the opposite direction. The standing EM wave can further be characterized by a measure of voltage at the point 110 that is effectively zero and a measure of voltage at the point 116 that oscillates between a maximum value and an equal but opposite maximum value.

Having the conductive connector 114 connecting the conductive surface 112 to the ground plane 106 of the printed circuit board 104 at the point 116 and having the conductive surface 112 disposed substantially parallel to the ground plane 106 of the printed circuit board 104 can cause the oscillation of the current of the electrical signal provided by the antenna feed 108 to occur in the conductive surface 112 in a manner that is similar to the oscillation of the current of the electrical signal in the ground plan 106 of the printed circuit board 104. A measure of the current at the point 116 in the conductive surface 112 can be effectively zero and a measure of the current at a point in the conductive surface 112 that corresponds to the point 110 can oscillate between a maximum value in one direction and an equal maximum value in the opposite direction.

In this manner, the oscillation of the current of the electrical signal in the conductive surface 112 can be in phase with the oscillation of the current of the electrical signal in the ground plane 106 of the printed circuit board 104. Having the oscillation of the current of the electrical signal in the conductive surface 112 in phase with the oscillation of the current of the electrical signal in the ground plane 106 of the printed circuit board 104 can cause a standing EM wave produced between the point 116 in the conductive surface 112 and the point in the conductive surface 112 that corresponds to the point 110 to be in phase with the standing EM wave produce between the point 116 in the ground plane 106 of the printed circuit board 104 and the point 110. Having the standing EM wave produced by the conductive surface 112 in phase with the standing EM wave produced by the ground plane 106 of the printed circuit board 104 can cause the EM wave produced by the conductive surface 112 to coherently combine with the EM wave produced by the ground plane 106 of the printed circuit board 104. Having the EM wave produced by the conductive surface 112 coherently combined with the EM wave produced by the ground plane 106 of the printed circuit board 104 can increase an amount of EM power radiated by the antenna of the wireless device 100. Because such an increase in the amount of EM power radiated by the antenna can be realized without an increase in EM power provided to the antenna, having an antenna that includes the conductive surface 112 and the conductive connector 114 configured as described can be more efficient than a corresponding antenna that lacks the conductive surface 112 and the conductive connector 114.

In a realization, the wavelength ($\lambda_1$) of the first electromagnetic wave to be exploited by the wireless device 100 can be a wavelength that corresponds to the frequency band from 824 MHz to 960 MHz. In a realization, having an antenna that includes the conductive surface 112 and the conductive connector 114 configured as described can increase an efficiency of the antenna by one decibel, in the frequency band from 824 MHz to 960 MHz, over an efficiency of a corresponding antenna that lacks the conductive surface 112 and the conductive connector 114. In a realization, the wireless device 100 can be a wireless hub, a wireless access point, a wireless gateway, or the like. For example, the wireless device 100 can be a wireless hub of a premises management system. (See FIG. 15.) The premises management system can include a security system.

Figure 2:
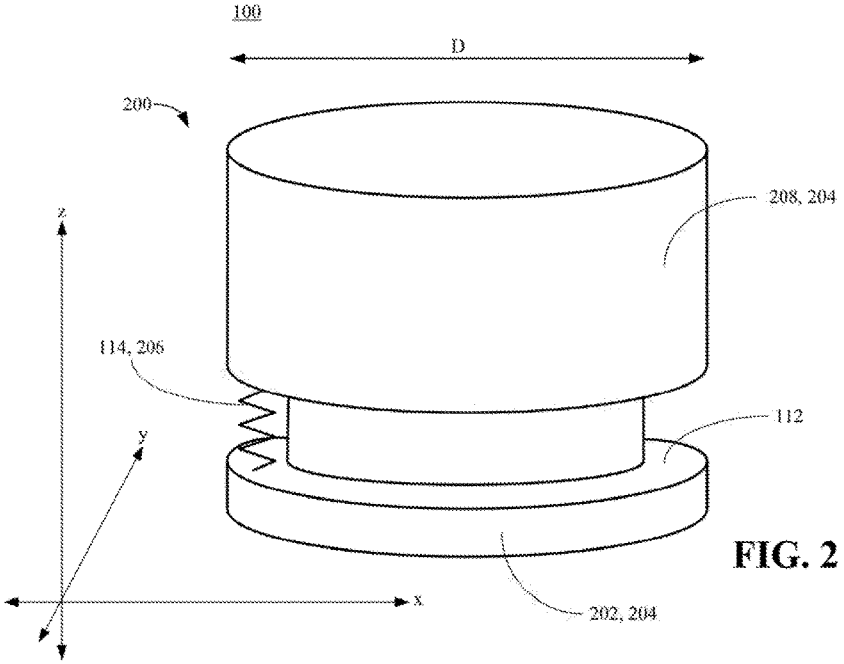
FIG. 2 is a block diagram illustrating a perspective view of an example of an implementation of the embodiment of the wireless device illustrated in FIG. 1.

FIG. 2 is a block diagram illustrating a perspective view of an example of an implementation 200 of the embodiment of the wireless device 100. In the implementation 200, the conductive surface 112 can be disposed on a base 202 of a housing 204 of the wireless device 100. In a realization, the base 202 can be a bezel of the wireless device 100. The conductive connector 114 can include, for example, a spring 206.

Figure 3:
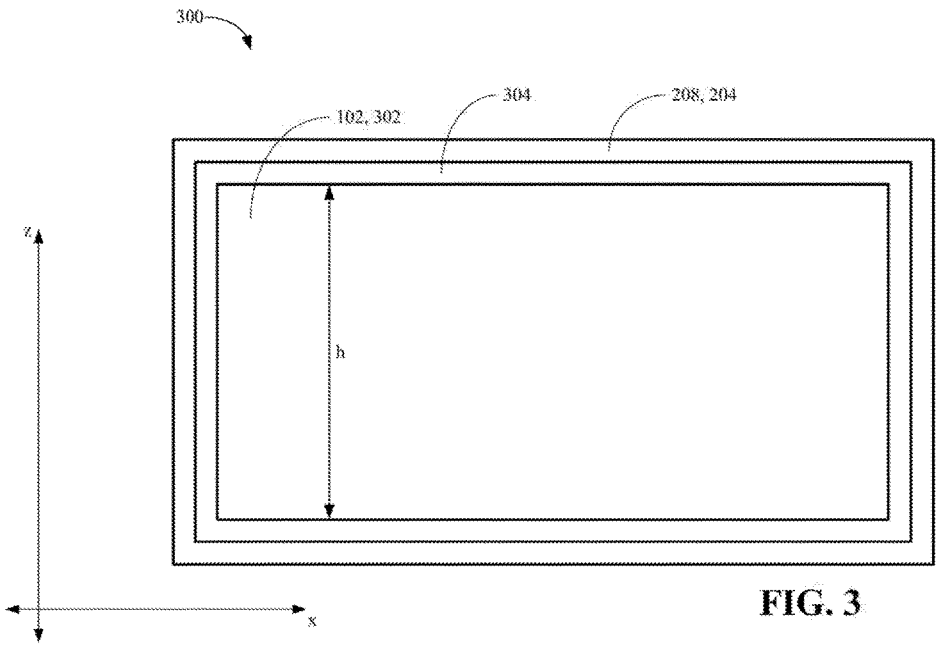
FIG. 3 is a block diagram illustrating a side view of an example of an implementation of the antenna element of the embodiment of the wireless device illustrated in FIG. 1.

FIG. 3 is a block diagram illustrating a side view of an example of an implementation 300 of the antenna element 102 of the embodiment of the wireless device 100. In the implementation 300, the antenna element 102 can include a conductive sheet 302. In an aspect, the conductive sheet 302 can be disposed on a flexible substrate 304, in a flexible substrate 304, or both. In a realization of the implementation 300, the conductive sheet 302 can have a height (h) of about 2.5 centimeters. With reference to FIGS. 2 and 3, the flexible substrate 304 can be disposed on a side 208 of the housing 204 of the wireless device 100, within the side 208 of the housing 204, or both.

Figure 4:
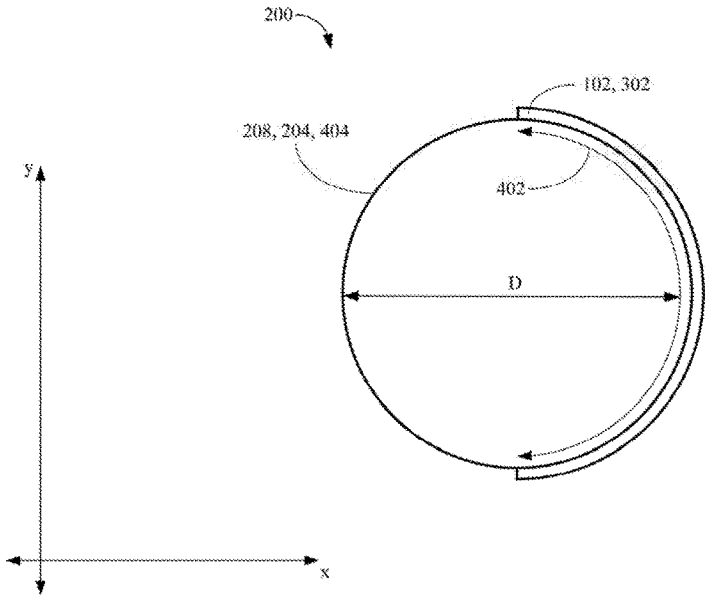
FIG. 4 is a block diagram illustrating a top view of the implementation of the embodiment of the wireless device illustrated in FIG. 2.

FIG. 4 is a block diagram illustrating a top view of the implementation 200 of the embodiment of the wireless device 100. With reference to FIGS. 2 through 4, the side 208 of the housing 204 can have a substantially cylindrical shape. A shape of a surface of the antenna element 102 can conform to an arc 402 of a circle 404 of the substantially cylindrical shape. In a realization of the implementation 200, the circle 404 can have a diameter (D) of five centimeters.

Although the implementation 200 of the embodiment of the wireless device 100 illustrated in FIGS. 2 and 4 has a substantially cylindrical shape, other implementations of the embodiment of the wireless device 100 can be realized having other shapes.

Figure 5:
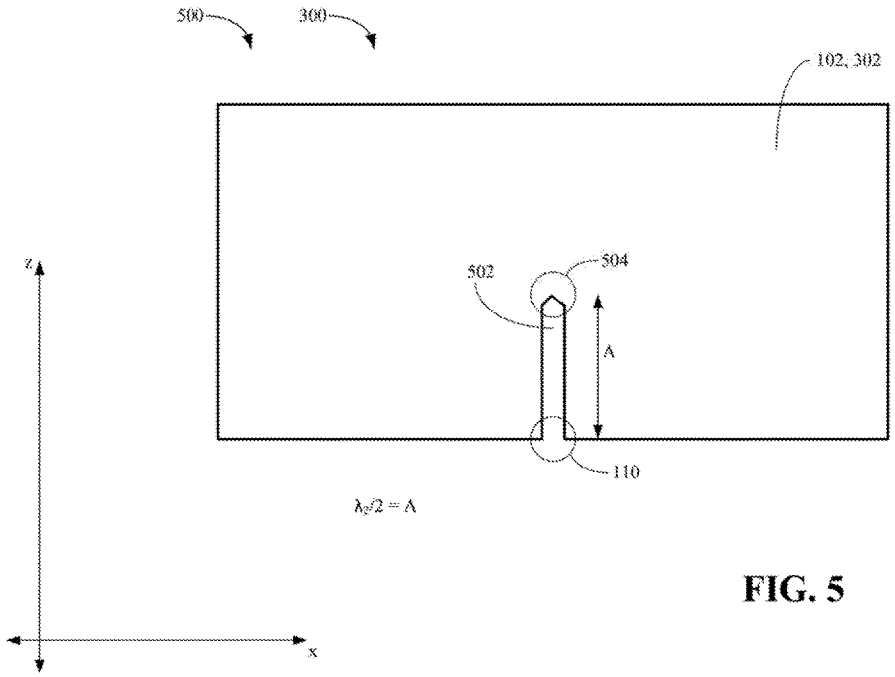
FIG. 5 is a block diagram illustrating a side view of an example of a variation of the implementation of the antenna element illustrated in FIG. 3.

FIG. 5 is a block diagram illustrating a side view of an example of a variation 500 of the implementation 300 of the antenna element 102 of the embodiment of the wireless device 100. In the variation 500, a first slot 502 can be formed in the conductive sheet 302 between the point 110 and a point 504. A distance (A) between the point 110 and the point 504 can be can be substantially equal to one half of a wavelength ($\lambda_2$) of a second electromagnetic wave to be exploited by the wireless device 100. Advantageously, having the antenna element 102 include the first slot 502 can allow the antenna of the wireless device 100 to be independently tuned to a first frequency band that includes the wavelength ($\lambda_1$) and to a second frequency band that includes the wavelength ($\lambda_2$). When an electrical signal having a center frequency that corresponds to the wavelength ($\lambda_2$) is provided, by the antenna feed 108 at the point 110, to the antenna element 102, a standing EM wave can be produced and radiated.

Figure 6:
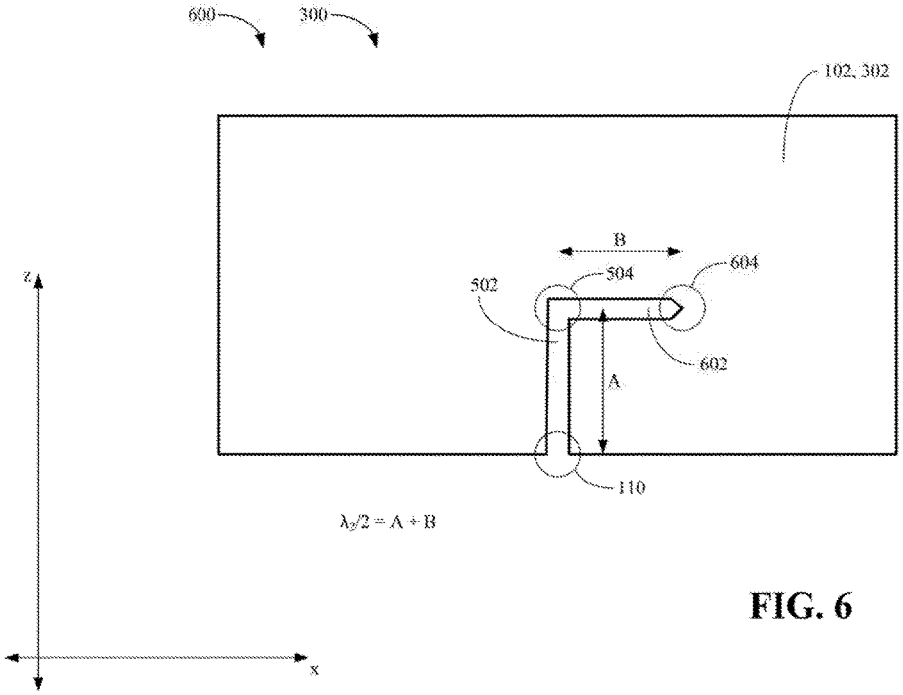
FIG. 6 is a block diagram illustrating a side view of an example of a variation of the implementation of the antenna element illustrated in FIG. 3.

FIG. 6 is a block diagram illustrating a side view of an example of a variation 600 of the implementation 300 of the antenna element 102 of the embodiment of the wireless device 100. In the variation 600, the first slot 502 can be formed in the conductive sheet 302 between the point 110 and the point 504. With reference to FIGS. 1 through 4 and 6, the first slot 502 can be substantially perpendicular to the ground plane 106 of the printed circuit board 104. A second slot 602 can be formed in the conductive sheet 302 between the point 502 and a point 604. The second slot 602 can be substantially perpendicular to the first slot 702. A sum of the distance (A) between the point 110 and the point 504 added to a distance (B) between the point 502 and the point 604 can be can be substantially equal to one half of the wavelength ($\lambda_2$) of the second electromagnetic wave to be exploited by the wireless device 100. Advantageously, having the antenna element 102 include the first slot 502 and the second slot 602 can allow the antenna of the wireless device 100 to be independently tuned to a first frequency band that includes the wavelength ($\lambda_1$) and to a second frequency band that includes the wavelength ($\lambda_2$). When an electrical signal having a center frequency that corresponds to the wavelength ($\lambda_2$) is provided, by the antenna feed 108 at the point 110, to the antenna element 102, a standing EM wave can be produced and radiated.

Figure 7:
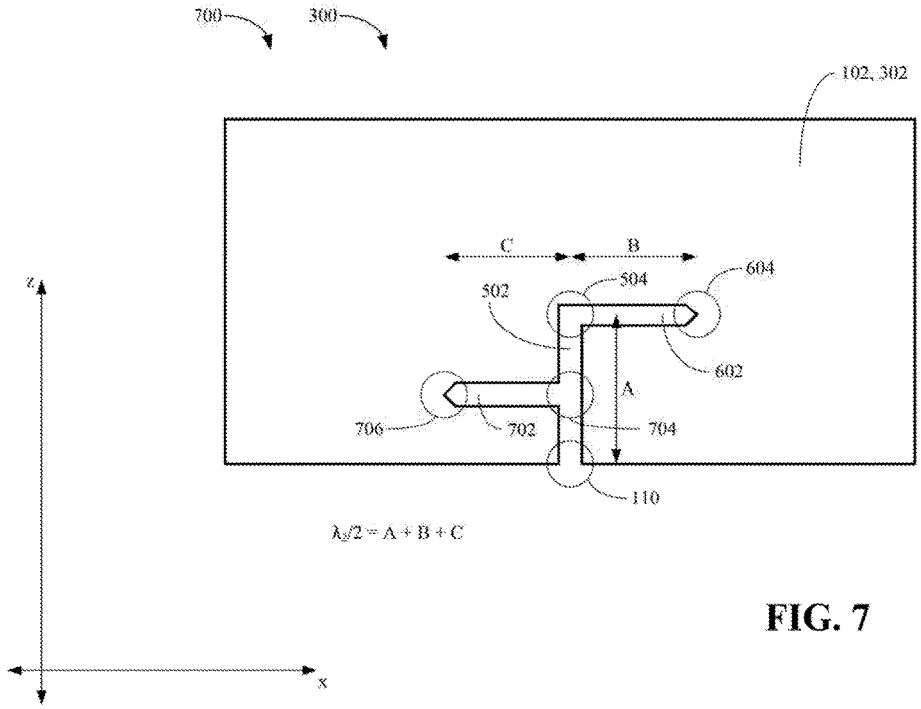
FIG. 7 is a block diagram illustrating a side view of an example of a variation of the implementation of the antenna element illustrated in FIG. 3.

FIG. 7 is a block diagram illustrating a side view of an example of a variation 700 of the implementation 300 of the antenna element 102 of the embodiment of the wireless device 100. In the variation 700, the first slot 502 can be formed in the conductive sheet 302 between the point 110 and the point 504. With reference to FIGS. 1 through 4 and 7, the first slot 502 can be substantially perpendicular to the ground plane 106 of the printed circuit board 104. The second slot 602 can be formed in the conductive sheet 302 between the point 502 and the point 604. The second slot 602 can be substantially perpendicular to the first slot 702. A third slot 702 can be formed in the conductive sheet 302 between a point 704 and a point 706. The point 704 can be between the point 110 and the point 504. The third slot 702 can be substantially perpendicular to the first slot 502. A sum of the distance (A) between the point 110 and the point 504 added to the distance (B) between the point 502 and the point 604 added to a distance (C) between the point 704 and the point 706 can be can be substantially equal to one half of the wavelength ($\lambda_2$) of the second electromagnetic wave to be exploited by the wireless device 100. Advantageously, having the antenna element 102 include the first slot 502, the second slot 602, and the third slot 702 can allow the antenna of the wireless device 100 to be independently tuned to a first frequency band that includes the wavelength ($\lambda_1$) and to a second frequency band that includes the wavelength ($\lambda_2$). When an electrical signal having a center frequency that corresponds to the wavelength ($\lambda_2$) is provided, by the antenna feed 108 at the point 110, to the antenna element 102, a standing EM wave can be produced and radiated. In a realization, having an antenna that includes the first slot 502, the second slot 602, and the third slot 702 configured as described can increase a bandwidth of the antenna over a bandwidth of an antenna that lacks slots configured in this manner. In a realization, the wavelength ($\lambda_2$) of the second electromagnetic wave to be exploited by the wireless device 100 can be a wavelength that corresponds to the frequency band from 1710 MHz to 2170 MHz.

Figure 8:
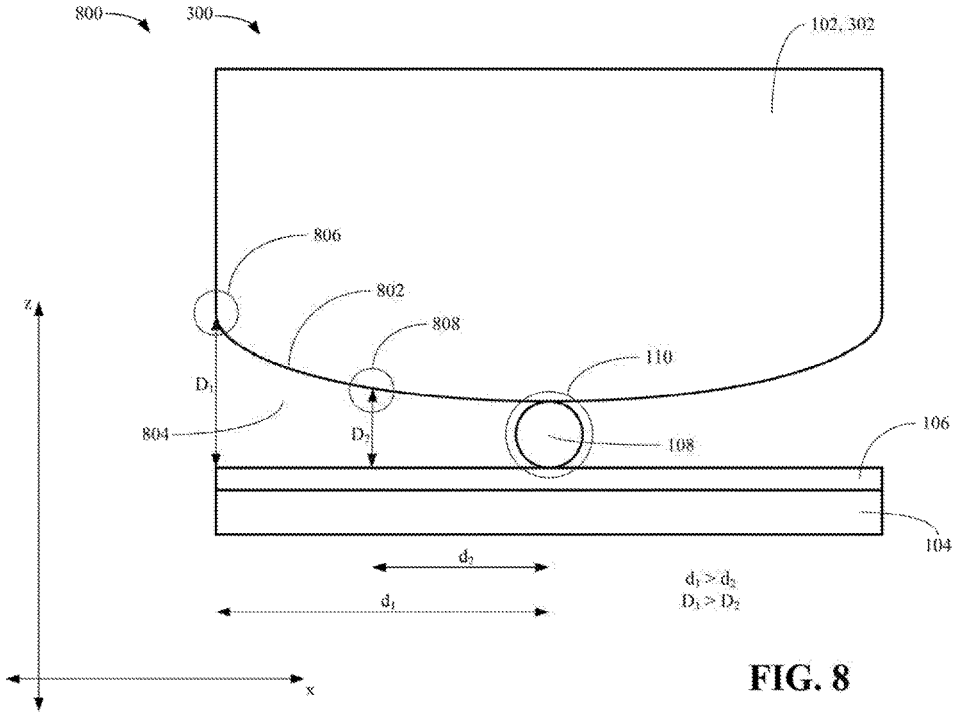
FIG. 8 is a block diagram illustrating a side view of an example of a variation of the implementation of the antenna element illustrated in FIG. 3.

FIG. 8 is a block diagram illustrating a side view of an example of a variation 800 of the implementation 300 of the antenna element 102 of the embodiment of the wireless device 100. In the variation 800, a shape of an edge 802 of the antenna element 102 can form a space 804 between the antenna element 102 and the ground plane 106 of the printed circuit board 104. On the edge 802, a distance ($d_1$) between the point 110 and a point 806 can be greater than a distance ($d_2$) between the point 110 and a point 808. On the edge 802, a distance ($D_1$), at the point 806, between the antenna element 102 and the ground plane 106 of the printed circuit board 104 can be greater than a distance ($D_2$), at the point 808, between the antenna element 102 and the ground plane 106 of the printed circuit board 104. In an aspect, the shape of the edge 802 can have a curvature. Advantageously, having the antenna of the wireless device 100 include the space 804 as described can reduce parasitic capacitance in the antenna. Parasitic capacitance can reduce a bandwidth of the antenna.

Figure 9:
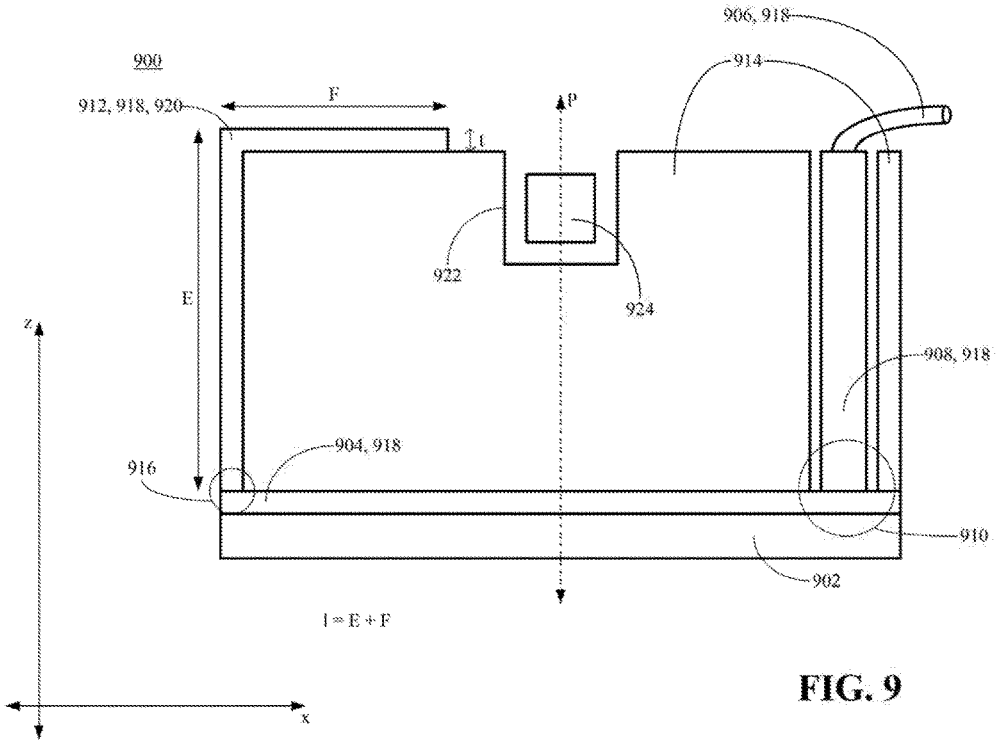
FIG. 9 is a block diagram illustrating a side view of an example of an embodiment of a wireless device according to the disclosed subject matter.

FIG. 9 is a block diagram illustrating a side view of an example of an embodiment of a wireless device 900 according to the disclosed subject matter. The wireless device 900 can include can a printed circuit board 902, a power cord 906, and a ground extension 912. The printed circuit board 902 can have a ground plane 904. The power cord 906 can have a connector 908. The connector 908 can be configured to connect, at a point 910, the power cord 906 to the ground plane 904 of the printed circuit board 902. The ground extension 912 can be disposed on a housing 914 of the wireless device 900, within the housing 914, or both. The ground extension 912 can be connected, at a point 916, to the ground plane 904 of the printed circuit board 902. The point 916 can be substantially opposite the point 910. A ground plane 918 of an antenna of the wireless device 900 can include the ground plane 904 of the printed circuit board 902, the power cord 906, the connector 908, and the ground extension 912. For example, the power cord 906 can be a Universal Serial Bus™ cable. For example, the ground extension 912 can be a conductive sheet 920. Advantageously, having the antenna of the wireless device 900 include the ground extension 912 can increase an overall area of the ground plane 918 of the antenna such that a greater amount of a surface area of the antenna can be used to radiate EM power. This can increase the efficiency of the antenna of the wireless device 900, the bandwidth of the antenna of the wireless device 900, or both.

In a realization, the wireless device 900 can be a wireless hub, a wireless access point, a wireless gateway, or the like. For example, the wireless device 900 can be a wireless hub of a premises management system. (See FIG. 15.) The premises management system can include a security system.

Figure 10:
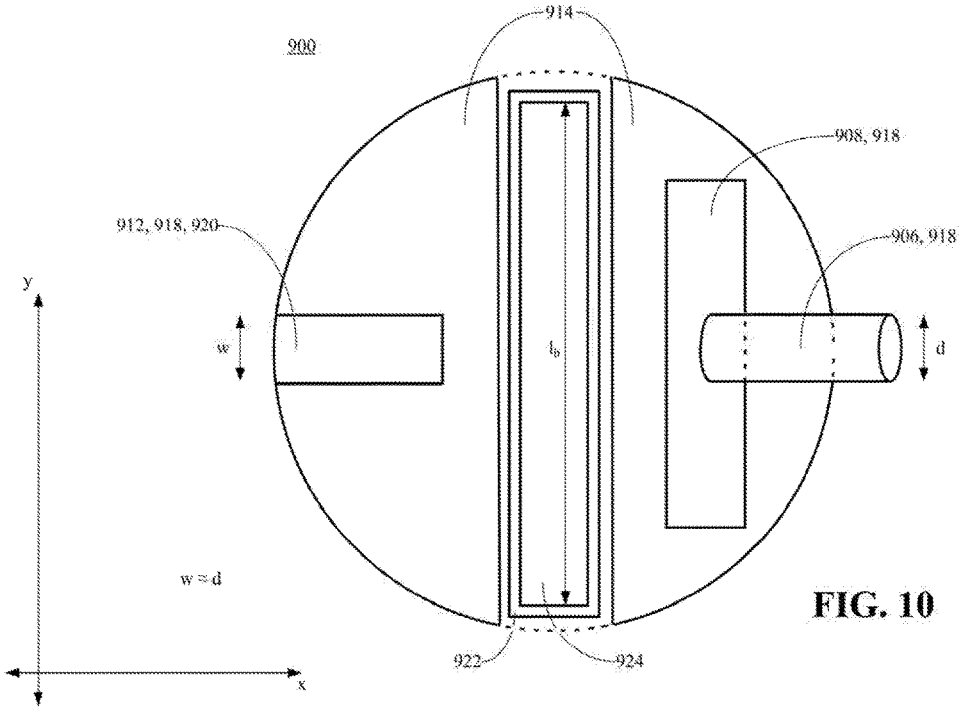
FIG. 10 is a block diagram illustrating a top view of the embodiment of the wireless device illustrated in FIG. 9.

FIG. 10 is a block diagram illustrating a top view of the embodiment of the wireless device 900. With reference to FIGS. 9 and 10, the conductive sheet 920 can have a length (l), a width (w), and a thickness (t). The length (l) can be equal to a sum of a distance (E) added to a distance (F). The width (w) of the conductive sheet 920 can be substantially equal to a diameter (d) of the power cord 906.

With continued reference to FIGS. 9 and 10, the wireless device 900 can further include a holder 922. The holder 922 can be configured to hold a battery 924 such that, when the battery 924 is held by the holder 922, a length ($l_b$) of the battery 924 is substantially parallel to a plane (P) perpendicular to a line formed by the point 910 and the point 916.

Figure 11:
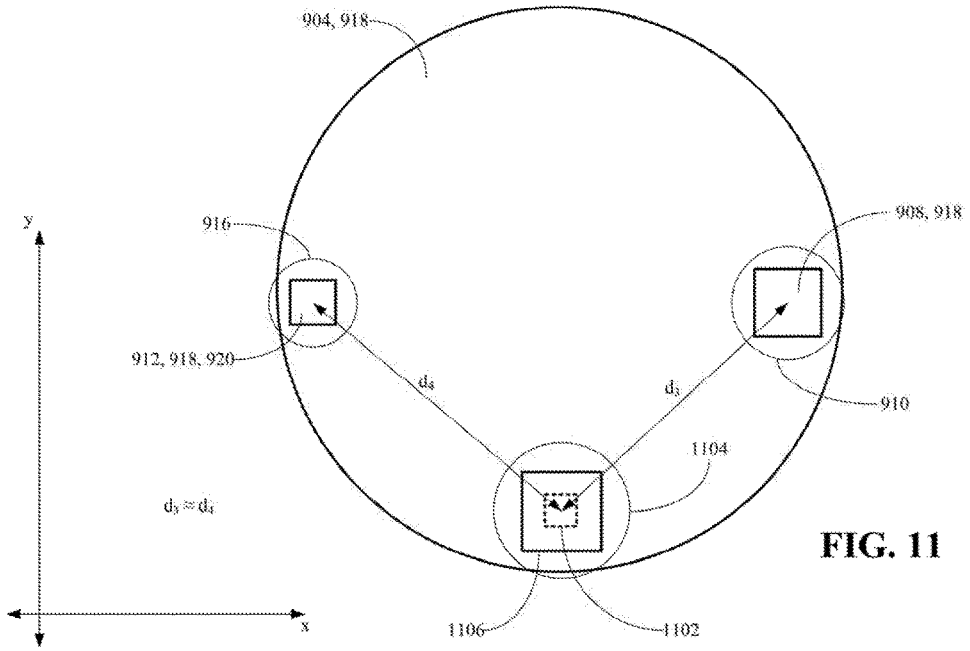
FIG. 11 is a block diagram illustrating a top view of an example of an implementation of the ground plane of the printed circuit board of the embodiment of the wireless device illustrated in FIG. 9.

FIG. 11 is a block diagram illustrating a top view of an example of an implementation of the ground plane 904 of the printed circuit board 902 of the embodiment of the wireless device 900. The wireless device 900 can further include an antenna feed 1102. The antenna feed 1102 can be connected, at a point 1104, to an antenna element 1106 and to the ground plane 904 of the printed circuit board 902. A distance (d3) between the point 1104 and the point 910 (at which the connector 908 can be connected to the ground plane 904 of the printed circuit board 902) can be substantially equal to a distance (d4) between the point 1104 and the point 916 (at which the ground extension 912 can be connected to the ground plane 904 of the printed circuit board 902).

With reference to FIGS. 9 through 11, when an electrical signal having a specific frequency is provided, by the antenna feed 1102, in a balanced manner to the antenna element 1106 and to the ground plane 918 of the antenna of the wireless device 900, oscillation of currents of the electrical signal can occur in the antenna element 1106 and in the ground plane 918 of the antenna of the wireless device 900. Oscillation of these currents can produce the radiation patterns in the antenna element 1106 and in the ground plane 918 of the antenna of the wireless device 900. If the oscillation of the current in the ground plane 918 of the antenna of the wireless device 900 is similar to the oscillation of the current in the antenna element 1106, then a radiation pattern produced in the ground plane 918 of the antenna of the wireless device 900 can be similar to a radiation pattern produced by the antenna element 1106.

Having the power cord 906 included in the ground plane 918 of the antenna of the wireless device 900 can provide a conductive path that can cause the current in the ground plane 918 to be biased toward the power cord 906. This can introduce a distortion in the radiation pattern produced by the ground plane 918. Advantageously, having the ground extension 912, configured as described, included in the ground plane 918 can provide a conductive path opposite of the conductive path provided by the power cord 906. Having both the conductive path provided by the power cord 906 and the conductive path provided by the ground extension 912 can act to undo the bias, toward the power cord 906, which can exist in the current in the ground plane 918 if the ground plane 918 lacks the ground extension 912. This, in turn, can act to increase the uniformity of the radio frequency current in the ground plane 918 such that a greater amount of a surface area of the antenna of the wireless device 900 can be used to radiate EM power. This can increase the efficiency of the antenna of the wireless device 900, the bandwidth of the antenna of the wireless device 900, or both.

Although the embodiment of the wireless device 900 illustrated in FIGS. 9 through 11 has a substantially cylindrical shape, other embodiments of the wireless device 900 can be realized having other shapes.

Figure 12:
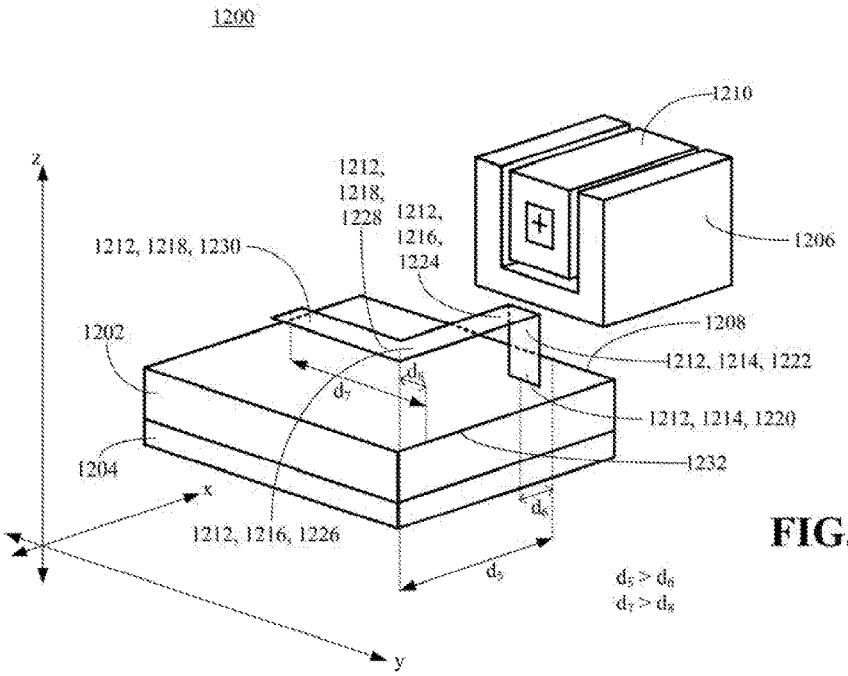
FIG. 12 is a block diagram illustrating a perspective view of an example of an embodiment of a wireless device according to the disclosed subject matter.

FIG. 12 is a block diagram illustrating a perspective view of an example of an embodiment of a wireless device 1200 according to the disclosed subject matter. The wireless device 1200 can include a printed circuit board 1202, a holder 1206, and a driven antenna element 1212. The printed circuit board 1202 can have a ground plane 1204. The holder 1206 can be disposed near a first edge 1208 of the printed circuit board 1202. The holder 1206 can be configured to hold a battery 1210. The driven antenna element 1212 can have a first elongated portion 1214, a second elongated portion 1216, and a third elongated portion 1218.

The first elongated portion 1214 can have a first end 1220 and a second end 1222. The first end 1220 of the first elongated portion 1214 can be connected to the printed circuit board 1202. In an aspect, an angle of 0°, an angle between 0° and 90°, or an angle of 90° can be formed between the first elongated portion 1214 and the ground plane 1204 of the printed circuit board 1204. For example, the first elongated portion 1214 can be disposed substantially perpendicular to the ground plane 1204 of the printed circuit board 1202.

The second elongated portion 1216 can have a first end 1224 and a second end 1226. The first end 1224 of the second elongated portion 1216 can be connected to the second end 1222 of the first elongated portion 1214. In an aspect, an angle of 0°, an angle between 0° and 90°, or an angle of 90° can be formed between the second elongated portion 1216 and the ground plane 1204 of the printed circuit board 1202. For example, the second elongated portion 1216 can be disposed substantially parallel to the ground plane 1204 of the printed circuit board 1202. A distance ($d_5$) between the second end 1226 of the second elongated portion 1216 and the first edge 1208 of the printed circuit board 1202 can be greater than a distance ($d_6$) between the first end 1224 of the second elongated portion 1216 and the first edge 1208 of the printed circuit board 1202. In an aspect, an angle of 0°, an angle between 0° and 180°, or an angle of 180° can be formed between the second elongated portion 1216 and a line, parallel to the first edge 1208 of the printed circuit board 1202, which passes through the first end 1224 of the second elongated portion 1216. For example, the second elongated portion 1216 can be disposed substantially perpendicular to the line, parallel to the first edge 1208 of the printed circuit board 1202, that passes through the first end 1224 of the second elongated portion 1216. Because the battery 1210 can be disposed near the first edge 1208 of the printed circuit board 1202 and because conductive material of the battery 1210 can act to absorb radiation produced by an antenna of the wireless device 1200, having the second elongated portion 1216 disposed, from the first end 1224 of the second elongated portion 1216, in a direction away from the battery 1210 advantageously can increase an efficiency of the antenna.

The third elongated portion 1218 can have a first end 1228 and a second end 1230. The first end 1228 of the third elongated portion 1218 can be connected to the second end 1226 of the second elongated portion 1216. In an aspect, an angle of 0°, an angle between 0° and 90°, or an angle of 90° can be formed between the third elongated portion 1218 and the ground plane 1204 of the printed circuit board 1202. For example, the third elongated portion 1218 can be disposed substantially parallel to the ground plane 1204 of the printed circuit board 1202. A second edge 1232 of the printed circuit board 1202 can be substantially perpendicular to the first edge 1208 of the printed circuit board. In an aspect, a distance ($d_7$) between the second end 1230 of the third elongated portion 1218 and the second edge 1232 of the printed circuit board 1202 can be greater than a distance ($d_8$) between the first end 1228 of the third elongated portion 1218 and the second edge 1232 of the printed circuit board 1202. An angle of 0°, an angle between 0° and 180°, or an angle of 180° can be formed between the third elongated portion 1218 and a line, parallel to the second edge 1232 of the printed circuit board 1202, which passes through the first end 1228 of the third elongated portion 1218. For example, the third elongated portion 1218 can be disposed substantially perpendicular to the line, parallel to the second edge 1232 of the printed circuit board 1202, that passes through the first end 1228 of the third elongated portion 1218. For example, the third elongated portion 1218 can be substantially perpendicular to the second elongated portion 1216.

Having an angle of 0° or an angle between 0° and 90° (i.e., not an angle of 90°) formed between the second elongated portion 1216 and the ground plane 1204 of the printed circuit board 1202, between the third elongated portion 1218 and the ground plane 1204 of the printed circuit board 1202, or both can increase the capacitive reactance of the antenna of the wireless device 1200. This, in turn, can cause an electrical length of a combination of the first elongated portion 1214, the second elongated portion 1216, and the third elongated portion 1218 to be greater than a physical length of the combination of the first elongated portion 1214, the second elongated portion 1216, and the third elongated portion 1218. Advantageously, having the electrical length of the antenna of the wireless device 1200 greater than the physical length of the antenna can allow the antenna of the wireless device 1200 to be used to exploit wavelengths that correspond to frequencies that are lower than the frequencies that could otherwise be exploited. Advantageously, having the electrical length of the antenna of the wireless device 1200 greater than the physical length of the antenna can allow such lower frequencies to be exploited with an antenna that can fit within a form factor constraint of the wireless device 1200.

Figure 13:
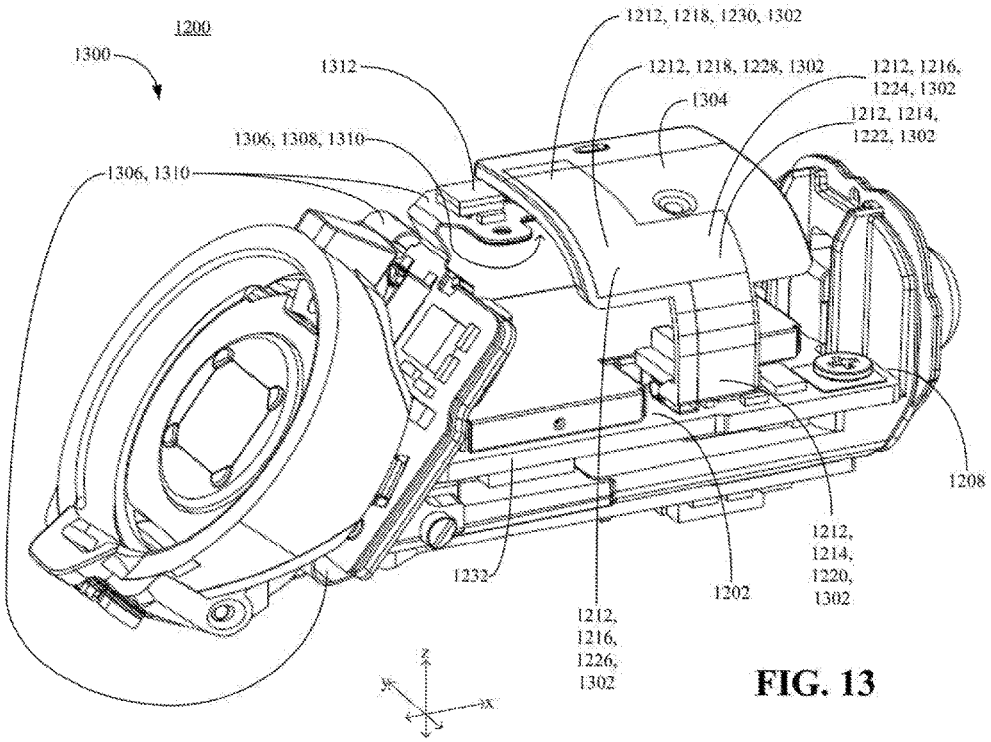
FIG. 13 is a diagram illustrating a perspective view of an example of an implementation of the embodiment of the wireless device illustrated in FIG. 12.

FIG. 13 is a diagram illustrating a perspective view of an example of an implementation 1300 of the embodiment of the wireless device 1200. In the implementation 1300, the driven antenna element 1212 can be an integrated antenna element 1302. The integrated antenna element 1302 can be disposed on a housing 1304 of the wireless device 1200, in the housing 1304, or both. The first elongated portion 1214 of the driven antenna element 1212, as illustrated in FIG. 13, can be considered to be disposed substantially perpendicular to the ground plane 1204 of the printed circuit board 1202 even though a shape of the first elongated portion 1214, as illustrated in FIG. 13, has a curvature that conforms to a shape of the housing 1304. The second elongated portion 1216 of the driven antenna element 1212, as illustrated in FIG. 13, can be considered to be disposed substantially parallel to the ground plane 1204 of the printed circuit board 1202 and can be considered to be disposed substantially perpendicular to the line, parallel to the first edge 1208 of the printed circuit board 1202, that passes through the first end 1224 of the second elongated portion 1216 even though a shape of the second elongated portion 1216, as illustrated in FIG. 13, has a curvature that conforms to the shape of the housing 1304. The third elongated portion 1218 of the driven antenna element 1212, as illustrated in FIG. 13, can be considered to be disposed substantially parallel to the ground plane 1204 of the printed circuit board 1202 and can be considered to be disposed substantially perpendicular to the line, parallel to the second edge 1232 of the printed circuit board 1202, that passes through the first end 1228 of the third elongated portion 1218 even though a shape of the third elongated portion 1218, as illustrated in FIG. 13, has a curvature that conforms to the shape of the housing 1304.

With continued reference to FIG. 13, the wireless device 1200 can further include a flexible printed circuit 1306. The flexible printed circuit 1306 can be connected to the printed circuit board 1202. A portion 1308 of the flexible printed circuit 1306 can be disposed near to the second end 1230 of the third elongated portion 1218 of the driven antenna element 1212. The portion 1308 of the flexible printed circuit 1306 can be unconnected to the second end 1230 of the third elongated portion 1218. Alternatively, the portion 1308 of the flexible printed circuit 1306 can lack a metallic connection to the second end 1230 of the third elongated portion 1218. For example, the portion 1308 of the flexible printed circuit 1306 can be connected to the second end 1230 of the third elongated portion 1218 by a non-metallic portion of the housing 1304. A disposition of the portion 1308 of the flexible printed circuit 1306 with respect to the second end 1230 of the third elongated portion 1218 can be substantially along a line perpendicular to the printed circuit board 1202. Alternatively, the disposition of the portion 1308 of the flexible printed circuit 1306 with respect to the second end 1230 of the third elongated portion 1218 can be substantially within a plane parallel to the printed circuit board 1202 (not illustrated).

In an aspect, the flexible printed circuit 1306 can be configured to function as a parasitic antenna element 1310. The parasitic antenna element 1310 can be configured to be coupled to the driven antenna element 1212 so that an electrical length of a combination of the parasitic antenna element 1310 and the driven antenna element 1212 can be greater than an electrical length of the driven antenna element 1212. Advantageously, having the electrical length of the combination of the parasitic antenna element 1310 and the driven antenna element 1212 greater than the length of the driven antenna element 1212 can allow the antenna of the wireless device 1200 to be used to exploit wavelengths that correspond to frequencies that are lower than the frequencies that could otherwise be exploited. Advantageously, such wavelengths can be exploited with an antenna that can fit within a form factor constraint of the wireless device 1200.

With continued reference to FIG. 13, the wireless device 1200 can further include a sensor 1312. For example, the sensor 1312 can be an ambient light sensor. The sensor 1312 can be mounted on the flexible printed circuit 1306. In an aspect, the sensor 1312 can be mounted on the flexible printed circuit 1306 near to the second end 1230 of the third elongated portion 1218 of the driven antenna element 1212. Advantageously, despite the presence of the sensor 1312, a shape of the driven antenna 1212, a shape of the flexible printed circuit 1306 (which can function as the parasitic antenna element 1310), or both can be disposed to cause EM power radiated by the antenna of the wireless device 1200 to be directed away from the wireless device 1200 rather than absorbed by components of the wireless device 1200. For example, as described, the flexible printed circuit 1306 can be connected to the printed circuit board 1202 and the portion 1302 of the flexible printed circuit 1306 can be disposed near to the second end 1230 of the third elongated portion 1218 of the driven antenna element 1212 substantially within a plane parallel to the printed circuit board 1202. One or more angles can be formed in the flexible printed circuit 1306 between the portion 1302 and a portion at which the flexible printed circuit 1306 is connected to the printed circuit board 1202. For example, an angle of about 135° can be formed between the portion 1302 and a middle portion of the flexible printed circuit 1306, and an angle of about 45° can be formed between the middle portion of the flexible printed circuit 1306 and the portion at which the flexible printed circuit 1306 is connected to the printed circuit board 1202. With the flexible printed circuit 1306 having such a shape, EM power radiated by the parasitic antenna element 1310 can be directed away from the battery 1210.

Figure 14:
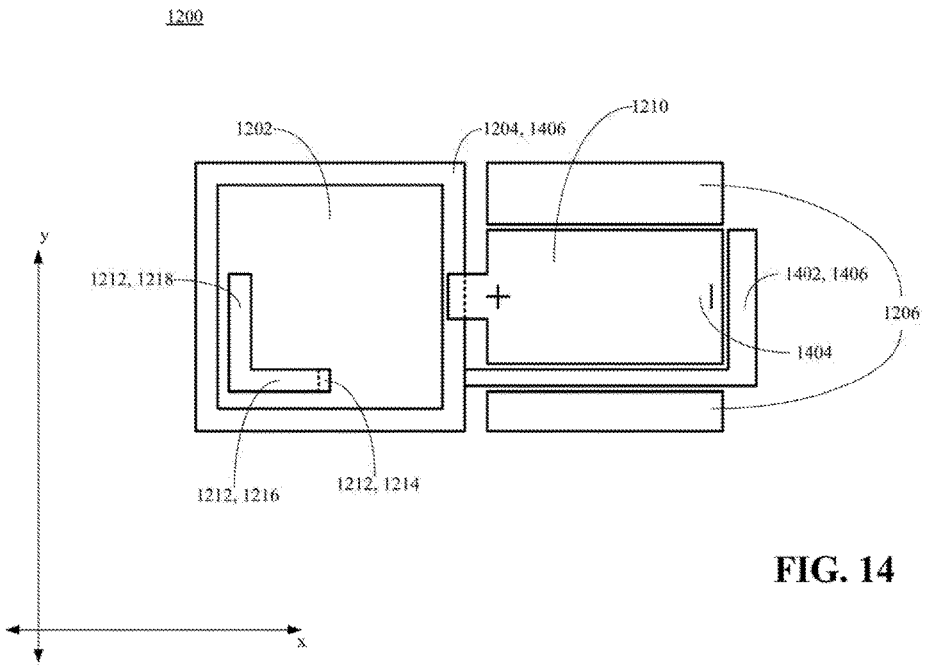
FIG. 14 is a block diagram illustrating a top view of the embodiment of the wireless device illustrated in FIG. 12.

FIG. 14 is a block diagram illustrating a top view of the embodiment of the wireless device 1200. The wireless device 1200 can further include a connector 1402. The connector 1402 can be connected to the ground plane 1204 of the printed circuit board 1202. The connector 1402 can be configured to be connected to a negative terminal 1404 of the battery 1210. In an aspect, a ground plane 1406 of an antenna of the wireless device 1200 can include the connector 1402 and the ground plane 1204 of the printed circuit board 1202. Advantageously, having the antenna of the wireless device 1200 include the connector 1402 can increase an overall area of the ground plane 1406 of the antenna such that a greater amount of a surface area of the antenna can be used to radiate EM power. This can increase the efficiency of the antenna of the wireless device 1200, the bandwidth of the antenna of the wireless device 1200, or both.

Various features of one of the wireless devices 100, 900, or 1200 can be incorporated into one or more other of the wireless devices 100, 900, or 1200. For example, the conductive surface 112 and the conductive connector 114, of the wireless device 100, can be incorporated into the wireless devices 900 or 1200. Moreover, the antenna element 1106, of the wireless device 900, can include the conductive sheet 302 described with reference to the wireless device 100. Additionally, the ground extension 912, of the wireless device 900, can be incorporated into the wireless device 100.

Figure 15:
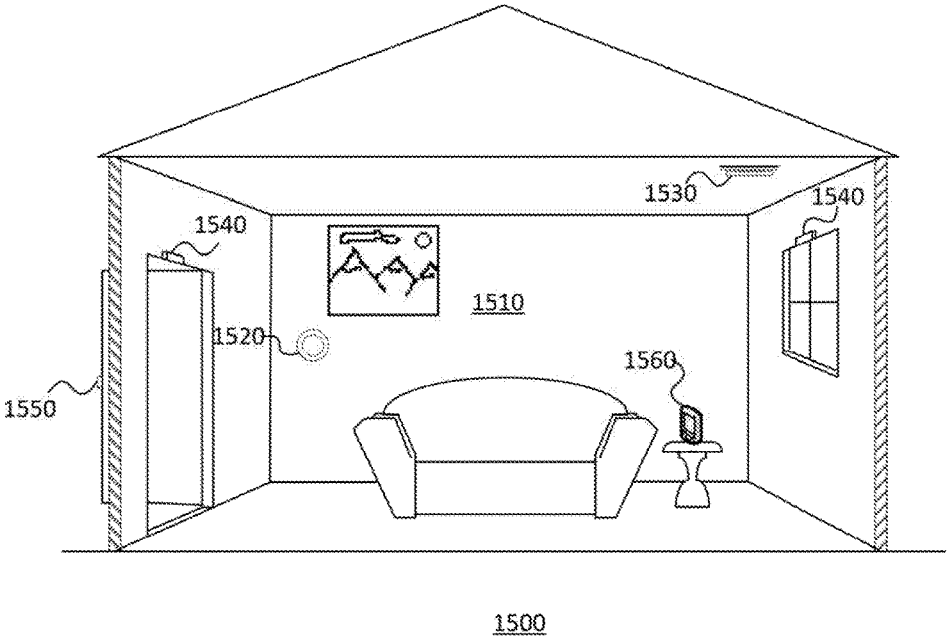
FIG. 15 is a diagram illustrating an example environment in which one or more of the wireless devices illustrated in FIGS. 1 through 14 can operate.

FIG. 15 is a diagram illustrating an example environment in which one or more of the wireless devices illustrated in FIGS. 1 through 14 can operate. For example, one or more of the wireless devices illustrated in FIGS. 1 through 14 can be included in one or more components of a security system of a premises, such as a security system integrated in a smart home environment that can include sensors, interface components, and one or more processing units that process data generated by the sensors and that control the interface components. Data from the sensors can be used to determine the occurrence of a security breach or security related event, such as entry through a window of the premises, lengthy presence of an individual in an unusual location and an unusual time, or tampering with a lock of a door of the premises, etc. Upon the occurrence of such an event, the security system can determine, based on any of various algorithms, that an alarm is warranted and enter into an alarm mode, which can include automatically notifying a third party monitoring service as well as operating components of the system to provide visual and/or audible alerts, such as a siren sound, repeated beeping sound, or flashing lights.

Additionally, the security system can determine where a security breach has occurred and thereafter track the location of the unauthorized party, as well as the locations of authorized parties within and/or around the premises. In addition, in view of the high stress levels that can accompany experiencing an unauthorized intrusion, the security system can announce the location of the security breach and the location of the unauthorized party within the premises. In so doing the authorized occupants are automatically warned of which locations in/around the premises to avoid and the unauthorized party is simultaneously deterred from further advance due to the clear notice to the unauthorized party that he/she is being tracked. Alternatively, the location of the unauthorized party can be announced only to select devices so as to inform an authorized user while leaving the unauthorized party unaware that he/she is being tracked.

The security system can function as a subsystem of a smart facility network system and can incorporate a plurality of electrical and/or mechanical components, including intelligent, sensing, network-connected devices that can communicate with each other and/or can communicate with a central server or a cloud-computing system to provide any of a variety of security (and/or environment) management objectives in a home, office, building or the like. Such objectives, which can include, for example, managing alarms, notifying third parties of alarm situations, managing door locks, monitoring the premises, etc., herein are collectively referred to as "premises management."

A premises management system can further include other subsystems that can communicate with each other to manage different aspects of premises management as well as security. For example, a security subsystem can manage the arming, disarming, and activation of alarms and other security aspects of the premises, and a smart home environment subsystem can handle aspects such as light, temperature, and hazard detection of the premises. However, the premises management system can leverage data obtained in one subsystem to improve the functionality of another subsystem.

The security system can be operable to function in any of various modes or states. For example, security system modes can include "stay", "away" and "home" modes. In a "stay" mode the security system can operate under the assumption that authorized parties are present within the premises but will not be entering/leaving without notifying the system; therefore data from certain interior sensors can be given lower weight in determining whether an unauthorized party is present. In an "away" mode the security system can operate under the assumption that no authorized parties are in the premises; therefore data from all sensors, interior and exterior, can be accorded high weight in determining whether an unauthorized party is present. In a "home" mode the security system can operate under the assumption that authorized parties are within the premises and will be freely entering/leaving the premises without notifying the system; therefore data from certain sensors interior and exterior can be accorded low weight in determining whether an unauthorized party is present. It should be understood that these modes are merely examples and can be modified, removed, or supplemented by other modes.

In addition, the security system can function in any of various alarm states. For example, in a "green" or "low" alarm state the security system can operate under the assumption that all is well and no unauthorized parties have been detected within/around the premises. In a "yellow" or "medium" alarm state the security system can operate under the assumption that an unauthorized party is potentially present in or around the premises. In this state certain sensor data can be analyzed differently or additional confirmations of authorization, such as entering a code, can be required of to avoid escalation to a higher alarm state. In a "red" or "high" alarm state the security system can operate under the assumption that an unauthorized party has been detected on the premises and preventive measures can be taken, such as notifying a third party monitoring service and/or activating an alarm and announcement, as will be described later. It should be understood that greater or fewer gradients of alarm state can be included. Hereinafter, a heightened alarm can refer to an alarm state above the low alarm state.

The security system can be implemented as a stand-alone system or, as mentioned above, as a subsystem of a larger premises management system and can leverage data therefrom. For illustrative purposes and to demonstrate the cross use of data among systems, the security system can be part of a premises management system, such as a smart home network environment.

The individual hardware components of the premises management system that can be used to monitor and affect the premises in order to carry out premises management can be referred to as "premises management devices." The premises management devices described herein can include multiple physical hardware and firmware configurations, along with circuitry hardware (e.g., processors, memory, etc.), firmware, and software programming that are configured to carry out the methods and functions of a premises management system. The premises management devices can be controlled by a "brain" component, which can be implemented in a controller device.

FIG. 15 illustrates an example premises management system 1500, installed within a premises 1510. The system 1500 can implement subsystems, including the security system, via multiple types of premises management devices, such as one or more intelligent, multi-sensing, network-connected thermostats 1520, one or more intelligent, multi-sensing, network-connected hazard detection units 1530, one or more intelligent, multi-sensing, network-connected entry detection units 1540, one or more network-connected door handles 1550, one or more intelligent, multi-sensing, network-connected controller devices 1560, or any combination thereof. For example, the one or more controller devices 1560 can incorporate features of the wireless device 100, the wireless device 900, or both. For example, the one or more entry detection units 1540 can incorporate features of the wireless device 1200. Data from any of these premise management devices can be used by the security system, as well as for the respective primary functions of the premise management devices.

At a high level, the system 1500 can be configured to operate as a learning, evolving ecosystem of interconnected devices. New premises management devices can be added, introducing new functionality, expanding existing functionality, or expanding a spatial range of coverage of the system. Furthermore, existing premises management devices can be replaced or removed without causing a failure of the system 1500. Such removal can encompass intentional or unintentional removal of components from the system 1500 by an authorized user, as well as removal by malfunction (e.g., loss of power, destruction by intruder, etc.). Due to the dynamic nature of the system, the overall capability, functionality and objectives of the system 1500 can change as the constitution and configuration of the system 1500 change.

In order to avoid contention and race conditions among the interconnected devices, certain decisions, such as those that affect the premises management system 1500 at a system level or that involve data from multiple sources, can be centralized in the aforementioned "brain" component. The brain component can coordinate decision making across the system 1500 or across a designated portion thereof. The brain component is a system element at which, for example, sensor/detector states can converge, user interaction can be interpreted, sensor data can be received, and decisions can be made concerning the state, mode, or actions of the system 1500. Hereinafter, the system 1500 brain component can be referred to as the "primary system processor." The function of primary system processor can be implemented in the controller device 1560, for example, hard coded into a single device, or distributed virtually among one or more premises management devices within the system using computational load sharing, time division, shared storage, or other techniques.

However implemented, the primary system processor can be configured to control subsystems and components of the premises management system 1500, such as, for example, the disclosed security system and/or a smart home environment system. Furthermore, the primary system processor can be communicatively connected to control, receive data from, or transmit data to premises management devices within the system, as well as receive data from or transmit data to devices/systems external to the system 1500, such as third party servers, cloud servers, mobile devices, and the like.

In the embodiments disclosed herein, each of the premises management devices can include one or more sensors. In general, a "sensor" can refer to any device that can obtain information about its local environment and communicate that information in the form of data that can be stored or accessed by other devices and/or systems. Sensor data can form the basis of inferences drawn about the sensor's environment. For example, the primary system processor can use data from a plurality of sensors, e.g., including entry detection unit 1540, to determine whether an unauthorized party is attempting enter the premises 1510 through a window.

A brief description of sensors that may be included in the system 1500 follows. Examples provided are not intended to be limiting but are merely provided as illustrative subjects. The system 1500 can use data from the types of sensors in order to implement features of a security system. The system 1500 can employ data from any type of sensor that provides data from which an inference can be drawn about the environment in or around the premises 1510.

Generally, sensors can be described by the type of information they collect. For example, sensor types can include motion, smoke, carbon monoxide, proximity, temperature, time, physical orientation, acceleration, location, entry, presence, pressure, light, sound, and the like. A sensor also can be described in terms of the particular physical device that obtains the environmental information. For example, an accelerometer can obtain acceleration information, and thus can be used as a general motion sensor and/or an acceleration sensor. A sensor also can be described in terms of the specific hardware components used to implement the sensor. For example, a temperature sensor can include a thermistor, thermocouple, resistance temperature detector, integrated circuit temperature detector, or combinations thereof.

A sensor further can be described in terms of a function or functions the sensor performs within the system 1500. For example, a sensor can be described as a security sensor when it is used to determine security events, such as unauthorized entry.

A sensor can be operated for different functions at different times. For example, system 1500 can use data from a motion sensor to determine how to control lighting in the premises 1510 when an authorized party is present and use the data as a factor to change a security system mode or state on the basis of unexpected movement when no authorized party is present. In another example, the system 1500 can use the motion sensor data differently when a security system mode is in an "away" mode versus a "home" state, i.e., certain motion sensor data can be ignored while the system is in a "home" mode and acted upon when the system is in an "away" mode.

In some cases, a sensor can operate as multiple sensor types sequentially or concurrently, such as where a temperature sensor is used to detect a change in temperature, as well as the presence of a person or animal. A sensor also can operate in different modes (e.g., different sensitivity or threshold settings) at the same or different times. For example, a sensor can be configured to operate in one mode during the day and another mode at night. As another example, a sensor can operate in different modes based upon a mode or the disclosed security system, state of system 1500, or as otherwise directed by the primary system processor.

Multiple sensors can be arranged in a single physical housing, such as where a single device includes movement, temperature, magnetic, and/or other sensors. Such a housing can also be referred to as a sensor, premises management device, or a sensor device. For clarity, sensors can be described with respect to the particular functions they perform and/or the particular physical hardware used.

Figure 16:
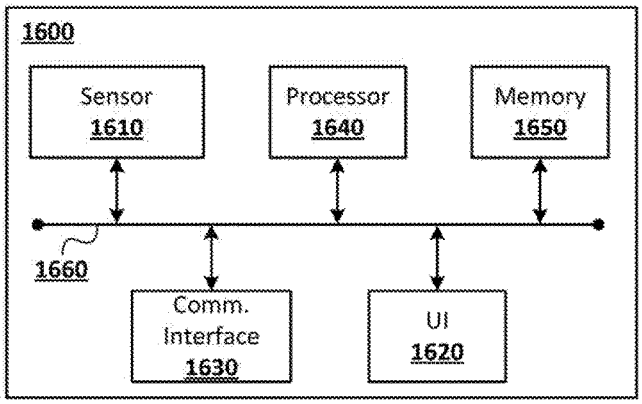
FIG. 16 is a block diagram illustrating an example of an embodiment of a premises management device.

FIG. 16 is a block diagram illustrating an example of an embodiment of a premises management device 1600. Premise management device 1600 can include a processor 1640, a memory 1650, a user interface (UI) 1620, a communications interface 1630, an internal bus 1660, and a sensor 1610. A person of ordinary skill in the art appreciates that various components of the premises management device 1600 described herein can include additional electrical circuit(s). Furthermore, it is appreciated that many of the various components listed above can be implemented on one or more integrated circuit (IC) chips. For example, in one embodiment, a set of components can be implemented in a single IC chip. In other embodiments, one or more of respective components can be fabricated or implemented on separate IC chips.

The sensor 1610 can be an environmental sensor, such as a temperature sensor, smoke sensor, carbon monoxide sensor, motion sensor, accelerometer, proximity sensor, passive infrared (PIR) sensor, magnetic field sensor, radio frequency (RF) sensor, light sensor, humidity sensor, pressure sensor, microphone, compass, or any other environmental sensor that obtains or provides a corresponding type of information about the environment in which the premises management device 1600 is located.

The processor 1640 can be a central processing unit (CPU) or other type of processor and can be communicably connected to the other components to receive and analyze data obtained by the sensor 1610, can transmit messages or packets that control operation of other components of the premises management device 1600 and/or external devices, and can process communications between the premises management device 1600 and other devices. The processor 1640 can execute instructions and/or computer executable components stored on the memory 1650. Such computer executable components can include, for example, a primary function component to control a primary function of the premises management device 1600 related to managing a premises, a communication component to locate and communicate with other compatible premises management devices, a computational component to process system related tasks, or any combination thereof.

The memory 1650 or another memory in the premises management device 1600 can also be communicably connected to receive and store environmental data obtained by the sensor 1610. A communication interface 1630 can function to transmit and receive data using a wireless protocol, such as a WiFi™, Thread®, or other wireless interface, Ethernet® or other local network interface, Bluetooth® or other radio interface, or the like and can facilitate transmission and receipt of data by the premises management device 1600 to and from other devices.

The user interface (UI) 1620 can provide information and/or receive input from a user of system 1500. The UI 1620 can include, for example, a speaker to output an audible sound when an event is detected by the premises management device 1600. Alternatively, or in addition, the UI 1620 can include a light to be activated when an event is detected by the premises management device 1600. The UI 1620 can be relatively minimal, such as a liquid crystal display (LCD), light-emitting diode (LED) display, or limited-output display, or it can be a full-featured interface such as a touchscreen, keypad, or selection wheel with a click-button mechanism to enter input.

Internal components of the premises management device 1600 can transmit and receive data to and from one another via an internal bus 1660 or other mechanism. One or more components can be implemented in a single physical arrangement, such as where multiple components are implemented on a single integrated circuit. Premises management devices 1600 can include other components, and/or may not include all of the components illustrated.

The sensor 1610 can obtain data about the premises, and at least some of the data can be used to implement the security system. Through the bus 1660 and/or communication interface 1630, sensor data can be transmitted to or accessible by other components of the system 1500. Generally, two or more sensors 1610 on one or more premises management devices 1600 can generate data that can be coordinated by the primary system processor to determine a system response and/or infer a state of the environment. In one example, the primary system processor of the system 1500 can infer a state of intrusion based on data from entry detection sensors and motion sensors and, based on the determined state, further determine whether an unauthorized party is present and a location, within the premises, of the unauthorized party.

Figure 17:
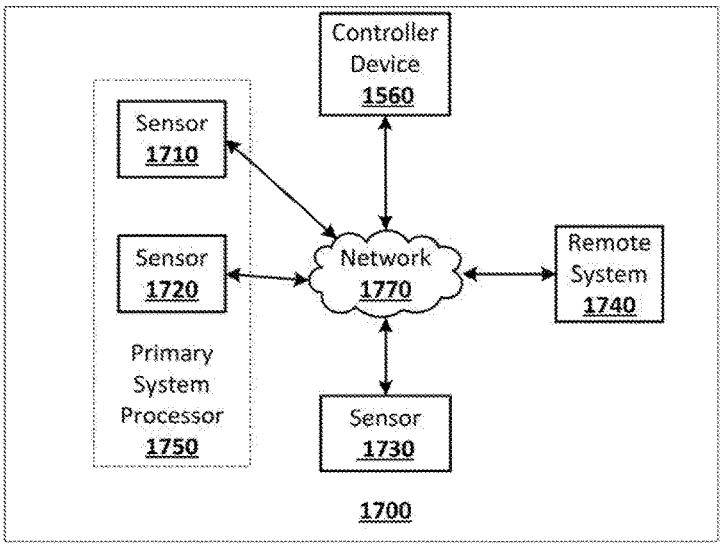
FIG. 17 is a block diagram illustrating an example of an embodiment of a premises management system.

FIG. 17 is a block diagram illustrating an example of an embodiment of a premises management system 1700. The premises management system 1700 can include security system features. System 1700 can be implemented over any suitable wired and/or wireless communication networks. One or more premises management devices, i.e., sensors 1710, 1720, 1730, and one or more controller devices 1560 can communicate via a local network 70, such as a WiFi™ or other suitable network, with each other. The network 1770 can include a mesh-type network such as Thread®, which can provide network architecture and/or protocols for devices to communicate with one another. An authorized party can therefore interact with the premises management system 1700, for example, using the controller device 1560, which can communicates with the rest of the system 1700 via the network 1770.

The controller device 1560 and/or one or more of the sensors 1710, 1720, 1730, can be configured to implement a primary system processor 1750. The primary system processor 1750 can, for example, receive, aggregate, and/or analyze environmental information received from the sensors 1710, 1720, 1730, and the controller device 1560. Furthermore, a portion or percentage of the primary system processor 1750 can be implemented in a remote system 1740, such as a cloud-based reporting and/or analysis system. The remote system 1740 can, for example, independently aggregate data from multiple locations, provide instruction, software updates, and/or aggregated data to a controller 1560, primary system processor 1750, and/or sensors 1710, 1720, 1730.

The sensors 1710, 1720, 1730, can be disposed locally to one another, such as within a single dwelling, office space, building, room, or the like, or they may be disposed remote from each other, such as at various locations around a wide perimeter of a premises. In some embodiments, sensors 1710, 1720, 1730, can communicate directly with one or more remote systems 1740. The remote system 1740 can, for example, aggregate data from multiple locations, provide instruction, software updates, and/or aggregated data to the primary system processor 1750, controller device 1560, and/or sensors 1710, 1720, 1730. In addition, remote system 1740 can refer to a system or subsystem that is a part of a third party monitoring service or a law enforcement service.

The premises management system illustrated in FIG. 17 can be a part of a smart-home environment, which can include a structure, such as a house, office building, garage, mobile home, or the like. The devices of the smart home environment, such as the sensors 1710, 1720, 1730, and the network 1770 can be integrated into a smart-home environment that does not include an entire structure, such as a single unit in an apartment building, condominium building, or office building.

The smart home environment can control and/or be coupled to devices outside of the structure. For example, one or more of the sensors 1710, 1720 can be located outside the structure at one or more distances from the structure (e.g., sensors 1710, 1720 can be disposed outside the structure, at points along a land perimeter on which the structure is located, or the like. One or more of the devices in the smart home environment may need not be physically within the structure. For example, the controller 1560, which can receive input from the sensors 1710, 1720, can be located outside of the structure.

The structure of the smart-home environment can include a plurality of rooms, separated at least partly from each other via walls. The walls can include interior walls or exterior walls. Each room can further include a floor and a ceiling. Devices of the smart-home environment, such as the sensors 1710, 1720, can be mounted on, integrated with, and/or supported by a wall, floor, or ceiling of the structure.

The controller device 1560 can be a general or special-purpose controller. For example, one type of controller device 1560 can be a general-purpose computing device running one or more applications that collect and analyze data from one or more sensors 1710, 1720, 1730 within the home. In this case, the controller device 1560 can be implemented using, for example, a mobile computing device such as a mobile phone, a tablet computer, a laptop computer, a personal data assistant, or wearable technology. Another example of a controller device 1560 can be a special-purpose controller that is dedicated to a subset of functions, such as a security controller that collects, analyzes and provides access to sensor data primarily or exclusively as it relates to various security considerations for a premises. The controller device 1560 can be located locally with respect to the sensors 1710, 1720, 1730 with which it can communicate and from which it can obtain sensor data, such as in the case where it is positioned within a home that includes a home automation and/or sensor network. Alternatively or in addition, controller device 1560 can be remote from the sensors 1710, 1720, 1730, such as where the controller device 1560 is implemented as a cloud-based system that can communicate with multiple sensors 1710, 1720, 1730, which can be located at multiple locations and can be local or remote with respect to one another.

Sensors 1710, 1720, 1730 can communicate with each other, the controller device 1560, and the primary system processor 1750 within a private, secure, local communication network that can be implemented wired or wirelessly, and/or a sensor-specific network through which sensors 1710, 1720, 1730 can communicate with one another and/or with dedicated other devices. Alternatively, as illustrated in FIG. 17, one or more sensors 1710, 1720, 1730 can communicate via a common local network 1770, such as a Wi-Fi™, Thread®, or other suitable network, with each other, and/or with the controller 1560 and primary system processor 1750. Alternatively or in addition, sensors 1710, 1720, 1730 can communicate directly with a remote system 1740.

The smart-home environment, including the sensor network shown in FIG. 17, can include a plurality of premises management devices, including intelligent, multi-sensing, network-connected devices that can integrate seamlessly with each other and/or with a central server or a cloud-computing system (e.g., controller 1560 and/or remote system 1740) to provide home-security and smart-home features. Such devices can include one or more intelligent, multi-sensing, network-connected thermostats (e.g., "smart thermostats"), one or more intelligent, network-connected, multi-sensing hazard detection units (e.g., "smart hazard detectors"), one or more intelligent, multi-sensing, network-connected entryway interface devices (e.g., "smart doorbells"), or any combination thereof. The smart hazard detectors, smart thermostats, and smart doorbells can be, for example, the sensors 1710, 1720, 1730 illustrated in FIG. 17. These premises management devices can be used by the security system, but can also have separate, primary functions.

For example, a smart thermostat can detect ambient climate characteristics (e.g., temperature and/or humidity) and can accordingly control a heating, ventilating, and air conditioning (HVAC) system of the structure. For example, the ambient climate characteristics can be detected by sensors 1710, 1720, 1730 illustrated in FIG. 17, and the controller 1560 can control the HVAC system (not illustrated) of the structure. However, unusual changes in temperature of a given room can also provide data that can supplement a determination of whether a situation is a security concern, for example, detecting a rapid drop in temperature in a given room due to a broken in window.

As another example, a smart hazard detector can detect the presence of a hazardous substance or a substance indicative of a hazardous substance (e.g., smoke, fire, or carbon monoxide). For example, smoke, fire, and/or carbon monoxide can be detected by sensors 1710, 1720, 1730 illustrated in FIG. 17, and the controller 1560 can control an alarm system to provide a visual and/or audible alarm to the user of the smart-home environment. However, the speaker of the hazard detector can also be used to announce security related messages.

As another example, a smart doorbell can control doorbell functionality, detect a person's approach to or departure from a location (e.g., an outer door to the structure), and announce a person's approach or departure from the structure via an audible and/or visual message that can be output by a speaker and/or a display coupled to, for example, the controller 1560. However, the detection of an approach of an unknown party can provide data to the security system to supplement determining whether the presence of the unknown party is a security concern.

A smart-home environment can include one or more intelligent, multi-sensing, network-connected entry detectors (e.g., "smart entry detectors") that can be specifically designed to function as part of a security subsystem. Such detectors can be or can include one or more of the sensors 1710, 1720, 1730 illustrated in FIG. 17. The smart entry detectors can be disposed at one or more windows, doors, and other entry points of the smart-home environment to detect when a window, door, or other entry point is opened, broken, breached, and/or compromised. The smart entry detectors can generate a corresponding signal to be provided to the controller 1560, primary system processor 1750, and/or the remote system 1740 when a window or door is opened, closed, breached, and/or compromised. In some embodiments of the security system, the alarm, which can be included with controller 1560 and/or coupled to the network 1770, may not arm unless all smart entry detectors (e.g., sensors 1710, 1720, 1730) indicate that all doors, windows, entryways, and the like are closed and/or that all smart entry detectors are armed.

The smart thermostats, the smart hazard detectors, the smart doorbells, the smart entry detectors, and other premise management devices of a smart-home environment (e.g., as illustrated as sensors 1710, 1720, 1730 of FIG. 17) can be communicatively connected to each other via the network 1770, and to the controller 1560, primary system processor 1750, and/or remote system 1740.

One or more users can control one or more of the network-connected smart devices in the smart-home environment using a network-connected computer or portable electronic device. In some examples, some or all of the users (e.g., individuals who live in the home) can register their mobile device, token and/or key fobs with the smart-home environment (e.g., with the controller 1560). Such registration can be made at a central server (e.g., the controller 1560 and/or the remote system 1740) to authenticate the user and/or the electronic device as being associated with the smart-home environment, and to provide permission to the user to use the electronic device to control the network-connected smart devices and the security system of the smart-home environment. A user can use their registered electronic device to remotely control the network-connected smart devices and security system of the smart-home environment, such as when the occupant is at work or on vacation. The user can also use their registered electronic device to control the network-connected smart devices when the user is located inside the smart-home environment.

Alternatively, or in addition to registering electronic devices, the smart-home environment can make inferences about which individuals live in the home and are therefore users and which electronic devices are associated with those individuals. As such, the smart-home environment can "learn" who is a user (e.g., an authorized user) and permit the electronic devices associated with those individuals to control the network-connected smart devices of the smart-home environment (e.g., devices communicatively coupled to the network 70) including, in some embodiments, sensors used by or within the smart-home environment. Various types of notices and other information can be provided to users via messages sent to one or more user electronic devices. For example, the messages can be sent via e-mail, short message service (SMS), multimedia messaging service (MMS), unstructured supplementary service data (USSD), as well as any other type of messaging services and/or communication protocols.

Figure 18:
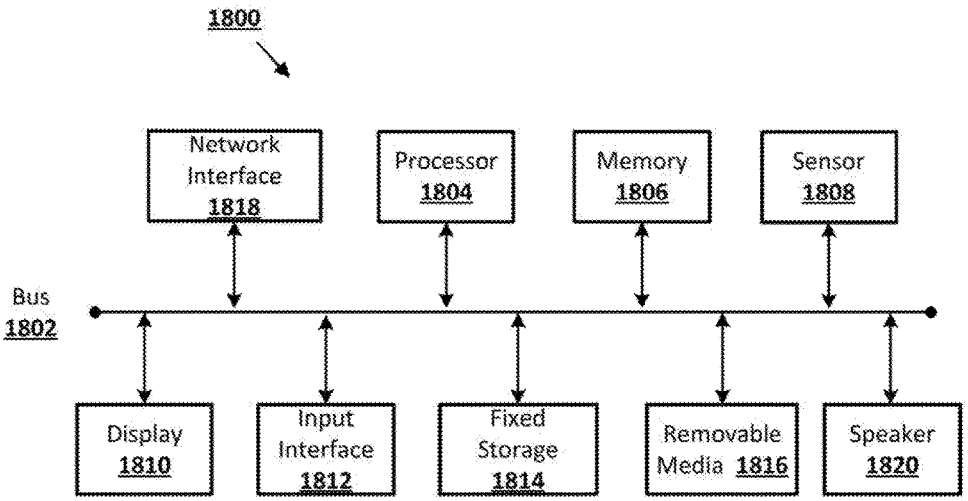
FIG. 18 is a block diagram illustrating an example of an embodiment of a computing device suitable for implementing certain devices illustrated in FIGS. 1 through 17.

FIG. 18 is a block diagram illustrating an example of an embodiment of a computing device 1800 suitable for implementing certain devices illustrated in FIGS. 1 through 17. The computing device 1800 can be used to implement, for example, the controller device 1560 or a premises management device including sensors as described above. The computing device 1800 can be constructed as a custom-designed device or can be, for example, a special-purpose desktop computer, laptop computer, or mobile computing device such as a smart phone, tablet, personal data assistant, wearable technology, or the like.

The computing device 1800 can include a bus 1802 that interconnects major components of the computing device 1800. Such components can include a central processor 1804; a memory 1806 (such as Random Access Memory (RAM), Read-Only Memory (ROM), flash RAM, or the like), a sensor 1808 (which can include one or more sensors), a display 1810 (such as a display screen), an input interface 1812 (which can include one or more input devices such as a keyboard, mouse, keypad, touch pad, turn-wheel, and the like), a fixed storage 1814 (such as a hard drive, flash storage, and the like), a removable media component 1816 (operable to control and receive a solid-state memory device, an optical disk, a flash drive, and the like), a network interface 1818 (operable to communicate with one or more remote devices via a suitable network connection), and a speaker 1820 (to output an audible communication). In some embodiments the input interface 1812 and the display 1810 can be combined, such as in the form of a touch screen.

The bus 1802 can allow data communication between the central processor 1804 and one or more memory components 1814, 1816, which can include RAM, ROM, or other memory. Applications resident with the computing device 1800 generally can be stored on and accessed via a computer readable storage medium.

The fixed storage 1814 can be integral with the computing device 1800 or can be separate and accessed through other interfaces. The network interface 1818 can provide a direct connection to the premises management system and/or a remote server via a wired or wireless connection. The network interface 1818 can provide such connection using any suitable technique and protocol, including digital cellular telephone, WiFi™, Thread®, Bluetooth®, near field communications (NFC), and the like. For example, the network interface 1818 can allow the computing device 1800 to communicate with other components of the premises management system or other computers via one or more local, wide-area, or other communication networks.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. A wireless device, comprising:

a printed circuit board having a ground plane;

a power cord having a connector configured to connect, at a first point, the power cord to the ground plane of the printed circuit board, a function of the power cord being to provide electrical supply power to the wireless device;

a ground extension disposed on or within a housing of the wireless device and connected, at a second point, to the ground plane of the printed circuit board, the second point substantially opposite the first point, wherein a ground plane of an antenna of the wireless device comprises the ground plane of the printed circuit board, the power cord, the connector, and the ground extension; and an antenna feed connected, at a third point, to an antenna element and to the ground plane of the printed circuit board, a distance between the third point and the first point substantially equal to a distance between the third point and the second point.

2. The wireless device of claim 1, wherein the wireless device is a wireless hub.

3. The wireless device of claim 2, wherein the wireless hub is a component of a premises management system.

4. The wireless device of claim 3, wherein the premises management system includes a security system.

5. The wireless device of claim 1, wherein the power cord is a Universal Serial Bus™ cable.

6. The wireless device of claim 1, wherein the ground extension comprises a conductive sheet.

7. The wireless device of claim 6, wherein the conductive sheet has a length, a width, and a thickness, the width being substantially equal to a diameter of the power cord.

8. The wireless device of claim 7, wherein the conductive sheet includes a first portion disposed along a top of the wireless device and a second portion disposed along a side of the wireless device.

9. The wireless device of claim 8, wherein the length of the conductive sheet is equal to a sum of a length of the first portion added to a length of the second portion.

10. The wireless device of claim 1, further comprising a holder configured to hold a battery such that, when the battery is held in the holder, a length of the battery is substantially parallel to a plane perpendicular to a line formed by the first point and the second point.

11. The wireless device of claim 1, wherein the antenna is configured to radiate electromagnetic power at a greater efficiency than an antenna having a ground plane that excludes the ground extension.

12. The wireless device of claim 1, wherein the antenna is configured to radiate electromagnetic power over a bandwidth that is larger than a bandwidth of an antenna having a ground plane that excludes the ground extension.

13. The wireless device of claim 1, wherein the wireless device is a wireless access point.

14. The wireless device of claim 1, wherein the wireless device is a wireless gateway.

15. The wireless device of claim 1, wherein the ground extension is configured to provide a conductive path opposite of a conductive path provided by the power cord.

16. The wireless device of claim 15, wherein the conductive path provided by the ground extension is configured to act to undo a bias, toward the power cord, in a current in the ground plane of the antenna.

17. The wireless device of claim 1, wherein the wireless device has a substantially cylindrical shape.

18. A wireless device, comprising:

a power cord having a connector configured to connect, at a first point, the power cord to a ground plane, a function of the power cord being to provide electrical supply power to the wireless device;

a ground extension disposed on or within a housing of the wireless device and connected, at a second point, to the ground plane, the second point substantially opposite the first point; and an antenna feed connected, at a third point, to an antenna element and to the ground plane, a distance between the third point and the first point substantially equal to a distance between the third point and the second point.

19. A wireless device, comprising:

a power cord having a connector configured to connect, at a first point, the power cord to a ground plane, a function of the power cord being to provide electrical supply power to the wireless device;

a ground extension disposed on or within a housing of the wireless device and connected, at a second point, to the ground plane, the second point substantially opposite the first point;

a holder configured to hold a battery such that, when the battery is held in the holder, a length of the battery is substantially parallel to a plane perpendicular to a line formed by the first point and the second point; and an antenna feed connected, at a third point, to an antenna element and to the ground plane, a distance between the third point and the first point substantially equal to a distance between the third point and the second point.

* * * * *